US008624523B2

(12) United States Patent
Briggs

(10) Patent No.: US 8,624,523 B2
(45) Date of Patent: Jan. 7, 2014

(54) CONTROL APPARATUS WITH CALIBRATION FUNCTIONALITY AND LIGHTING APPARATUS INCORPORATING CONTROL APPARATUS

(75) Inventor: Gerald Edward Briggs, Ottawa (CA)

(73) Assignee: Arkalumen Inc., Ottawa (CA)

( * ) Notice: Subject to any disclaimer, the term of this patent is extended or adjusted under 35 U.S.C. 154(b) by 301 days.

(21) Appl. No.: 13/104,902

(22) Filed: May 10, 2011

(65) Prior Publication Data

US 2011/0279055 A1 Nov. 17, 2011

Related U.S. Application Data

(60) Provisional application No. 61/333,742, filed on May 11, 2010.

(51) Int. Cl.
*H05B 37/02* (2006.01)

(52) U.S. Cl.
USPC ..... 315/291; 315/294; 315/361

(58) Field of Classification Search
USPC ..... 315/291, 250, 246, 287, 294, 361
See application file for complete search history.

(56) References Cited

U.S. PATENT DOCUMENTS 5,248,919 A * 9/1993 Hanna et al. ..... 315/291
7,683,504 B2 * 3/2010 Blair et al. ..... 307/141

* cited by examiner

*Primary Examiner* — Daniel D Chang
(74) *Attorney, Agent, or Firm* — Sean Murray; Murray IP Consulting Inc.

(57) ABSTRACT

Control apparatus for controlling an aspect of an apparatus are disclosed. In certain embodiments, the control apparatus comprises a dimmer that includes a variable impedance. In certain embodiments of the invention, the dimmer may be a TRIAC dimmer having a voltage at a gate electrode of the TRIAC that is always below a trigger voltage for the TRIAC such that the TRIAC never turns on and the remaining components within the TRIAC dimmer can be used as discreet components in a larger circuit. In the control apparatus, the dimmer may be coupled to a signal generation circuit that may generate an output signal whose frequency (period) is dictated at least in part by an impedance of the variable impedance. The output signal may be used to control an aspect of an apparatus such as the intensity, color or color temperature for a lighting apparatus.

26 Claims, 25 Drawing Sheets

CONTROL APPARATUS WITH CALIBRATION FUNCTIONALITY AND LIGHTING APPARATUS INCORPORATING CONTROL APPARATUS

CROSS-REFERENCE TO RELATED APPLICATION

The present application claims the benefit under 35 USC 119(e) of U.S. Provisional Patent Application 61/333,742 filed on May 11, 2010 and hereby incorporated by reference herein.

FIELD OF THE INVENTION

The invention relates generally to control systems and, more particularly, to control apparatus, lighting control apparatus and lighting apparatus incorporating control apparatus.

BACKGROUND

Light Emitting Diodes (LEDs) are increasingly being adopted as general illumination lighting sources due to their high energy efficiency and long service life relative to traditional sources of light such as incandescent, fluorescent and halogen. Each generation of LEDs are providing improvements in energy efficiency and cost per lumen, thus allowing for lighting manufacturers to produce LED light fixtures at increasingly cost competitive prices. These reduced costs are expanding the applications of LED lighting from niche markets, such as outdoor street lighting, Christmas lights and flashlights, to general illumination within offices, retail, industrial, and residential environments. Within these environments, users typically want an LED light fixture to operate in substantially the same manner as their current lighting solution with at least a similar set of functionality.

Within many applications for lighting, users desire the ability to adjust the intensity of a light fixture. Changes in intensity may be desired for a large number of reasons including to create a particular mood, to reduce energy, to adjust for other sources of light (ex. ambient sunlight), to reduce glare on objects (ex. televisions) or for another lighting effect. For incandescent lighting solutions, the most common control device for controlling the intensity of a light fixture is a dimmer that contains electrical circuits including a TRIAC and/or DIAC, the dimmer typically being called a TRIAC dimmer. One skilled in the art would understand that a TRIAC dimmer is typically implemented in series within the AC power line and cuts off portions of the AC power sine wave based on the setting of a potentiometer. The modified AC signal powers the incandescent light fixture at a lower power level than a full AC signal would have otherwise, thus lower lumens are projected from the light fixture.

LED light fixtures that initially were on the market could not operate with traditional TRIAC dimmers. Instead, custom dimming controllers were developed to interoperate with LED light fixtures to control a pulse width modulated (PWM) signal that could be used to adjust the intensity of the LEDs. A key problem is these custom dimmers can be considerably more expensive than standard TRIAC dimmers. This increase in cost is due to the incredible economies of scale that currently benefit TRIAC dimmers.

To overcome this cost dilemma and to reuse the TRIAC dimmer products and form factors that are currently on the market, a number of solutions have been developed to use standard TRIAC dimmers with LED lighting fixtures. For example, National Semiconductor of Santa Clara, Calif., U.S.A. has developed a TRIAC dimmable offline LED driver LM3445 which can be implemented within a constant current architecture to illuminate high power LEDs. This component includes a TRIAC dim decoder which can interpret the setting on the TRIAC dimmer and enable it to control the output current to the LEDs.

One problem with these solutions is related to the fundamental operation of the standard TRIAC dimmers. A TRIAC dimmer in operation generates a modified sinusoid in which portions of the waveform have been cut-off (or zeroed). When rectified within an AC/DC converter, the resulting DC power level requires additional components to ensure a constant voltage level is applied to the resulting LEDs. These additional components add inefficiencies to the system. Further, the TRIAC within the dimmer requires a holding current throughout the AC line cycle in order to operate properly. To maintain this holding current, additional resistors are required to create a load for the TRIAC. This load wastes power and reduces the efficiency of the overall light fixture.

Another problem with the current implementations of TRIAC dimmers as they relate to control of LED light fixtures is that these architectures are limited to controlling the intensity of the light fixture. Since the use of the TRIAC dimmer, as currently developed, reduces the power applied to the light fixture, the current TRIAC dimmer solutions do not operate well when the information being conveyed with the TRIAC dimmer is not intensity information but information related to another aspect of the light fixture, such as color or color temperature.

Additionally, certain lighting systems, including lighting systems employing LEDs, that are currently available have control systems that are designed to work with a 0-10V dimmer. It would be desirable to provide a control apparatus that may be used with a TRIAC dimmer to provide a variable voltage control signal so that control systems of this nature may be readily adapted for use with TRIAC dimmers.

Against this background, there is a need for solutions that will better control LEDs within a lighting apparatus in order to adjust aspects, such as intensity, color and/or color temperature, of the light output. Further, solutions that re-use existing lighting control interfaces can reduce the cost of new solutions.

SUMMARY OF THE INVENTION

According to a first aspect of the invention there is provided a control apparatus adapted for use with a dimmer, the dimmer comprising a variable impedance and an interface operable to change the variable impedance, the variable impedance in series with a capacitor coupled between a connection node and a reference ground, the control apparatus comprising: a signal generation circuit coupled to the dimmer at the connection node and operable to generate an output signal whose period is dictated at least in part by the impedance of the variable impedance.

According to a second aspect of the invention there is provided a control apparatus for use with a lighting apparatus comprising: a signal generation circuit operable to be coupled to a TRIAC dimmer having a variable impedance, the signal generation circuit operable to generate an output signal whose period is dictated at least in part by the variable impedance of the TRIAC dimmer.

According to another aspect of the invention there is provided a lighting apparatus for use with a dimmer, the dimmer comprising a variable impedance and an interface operable to change the variable impedance, the variable impedance in series with a capacitor coupled between a connection node and a reference ground, the lighting apparatus comprising: a light radiating element; a signal generation circuit coupled to the dimmer at the connection node and operable to generate an output signal whose period is dictated at least in part by the impedance of the variable impedance; and a lighting controller operable to receive the output signal and control an aspect of light output from the light radiating element based at least partially on the period of the output signal.

According to a further aspect of the invention there is provided a control apparatus adapted for use with a plurality of dimmers, each dimmer comprising a variable impedance and an interface operable to change the variable impedance, the variable impedance in series with a capacitor coupled between a connection node and a reference ground, the control apparatus comprising: a first signal generation circuit coupled to a first of the plurality of dimmers at the connection node of the first dimmer and operable to generate a first output signal whose period is dictated at least in part by the impedance of the variable impedance of the first dimmer; and a second signal generation circuit coupled to a second of the plurality of dimmers at the connection node of the second dimmer and operable to generate a second output signal whose period is dictated at least in part by the impedance of the variable impedance of the second dimmer.

According to yet another aspect of the invention there is provided a control apparatus adapted for use with a dimmer, the dimmer comprising a variable impedance and an interface operable to change the variable impedance, the variable impedance in series with a capacitor coupled between a connection node and a reference ground, the control apparatus comprising: a signal generation circuit coupled to the dimmer at the connection node and operable to generate an output signal whose period is dictated at least in part by the impedance of the variable impedance; a lighting controller operable: to receive the output signal from the signal generation circuit; detect a first period of the output signal when the interface of the dimmer is adjusted to a first extreme value by a user; detect a second period of the output signal when the interface of the dimmer is adjusted to a second extreme value by a user; and control an aspect of light output from a lighting apparatus based at least partially on the period of the output signal relative to the first and second periods.

According to another aspect of the invention there is provided a control apparatus adapted for use with a dimmer comprising an interface, the interface being adjustable and having a present value representative of the state of the interface, the control apparatus comprising: a lighting controller adapted to receive an output signal representative of the present value of the interface of the dimmer and operable to: determine a maximum value of the output signal; determine a minimum value of the output signal; and control an aspect of light output from a lighting apparatus based at least partially on the value of the interface relative to the maximum and minimum values.

According to a further aspect of the invention there is provided a control apparatus for use with a dimmer, the dimmer comprising a variable impedance and an interface operable to change the variable impedance, the variable impedance in series with a capacitor coupled between a connection node and a reference ground, the control apparatus comprising: a signal generation circuit coupled to an impedance matching circuit and operable to generate an output signal whose period is dictated at least in part by the impedance of the variable impedance of the dimmer; the impedance matching circuit coupled between the connection node of the dimmer and the signal generation circuit, wherein the impedance matching circuit is calibrated to define a predetermined maximum period and a predetermined minimum period of the output signal; and a lighting controller operable to receive the output signal and control an aspect of light output from a lighting apparatus based at least partially on the period of the output signal relative to the predetermined maximum and minimum periods.

According to a further still aspect of the invention there is provided a control apparatus for use with a dimmer, the dimmer comprising an interface, the interface being adjustable and having a present value representative of the state of the interface, the control apparatus comprising: a lighting controller coupled to the dimmer and operable to: detect a first value when the interface dimmer is adjusted to a first extreme value by a user; detect a second value when the interface dimmer is adjusted to a second extreme value by a user; and control an aspect of light output from the lighting apparatus based at least partially on the present value of the interface relative to the first and second values.

According to an additional aspect of the invention there is provided a method of controlling a lighting apparatus, the lighting apparatus comprising a dimmer comprising an interface, the interface being adjustable and having a value representative of the state of the interface, comprising the steps of: determining a maximum value of the value of the interface; determining a minimum value of the value of the interface; and controlling an aspect of light output from the lighting apparatus based at least partially on the value of the interface relative to the maximum and minimum values.

According to another aspect of the invention there is provided a control apparatus adapted for use with a dimmer comprising an interface, the interface being adjustable and having a present value representative of the state of the interface, the control apparatus comprising: a variable voltage signal generation circuit coupled to the dimmer, the variable voltage signal generation circuit operable to generate an output signal having a voltage that is representative of the present value of the interface of the dimmer.

According to a further aspect of the invention there is provided a control apparatus adapted for use with a dimmer, the dimmer comprising a variable impedance and an interface operable to change the variable impedance, the variable impedance in series with a capacitor coupled between a power supply node and an output node, the control apparatus comprising: a variable voltage signal generation circuit coupled to the output node of the dimmer, the variable voltage signal generation circuit operable to generate an output signal having a voltage that is representative of the impedance of the variable impedance of the dimmer.

According to a further aspect of the invention there is provided a control apparatus for use with a lighting apparatus comprising: a signal generation circuit operable to be coupled to a TRIAC dimmer having a variable impedance, the signal generation circuit operable to generate an output signal whose period is dictated at least in part by the variable impedance of the TRIAC dimmer; and a voltage conversion circuit operable to receive the output signal and generate a variable voltage output having a voltage that is dictated at least in part by the period of the output signal.

These and other aspects of the invention will become apparent to those of ordinary skill in the art upon review of the following description of certain embodiments of the invention in conjunction with the accompanying drawings.

BRIEF DESCRIPTION OF THE DRAWINGS

A detailed description of embodiments of the invention is provided herein below, by way of example only, with reference to the accompanying drawings, in which.

It is to be expressly understood that the description and drawings are only for the purpose of illustration of certain embodiments of the invention and are an aid for understanding. They are not intended to be a definition of the limits of the invention.

DETAILED DESCRIPTION OF EMBODIMENTS

The present invention is directed to apparatus and system for controlling lighting devices. Within embodiments described below, a control apparatus is used to control an aspect of a lighting apparatus such as the intensity, color and/or color temperature. Embodiments of the present invention can be utilized to control lighting apparatus of various technologies including Light Emitting Diodes (LEDs), fluorescent, halogen, incandescent, high pressure sodium etc.

Figure 1A:
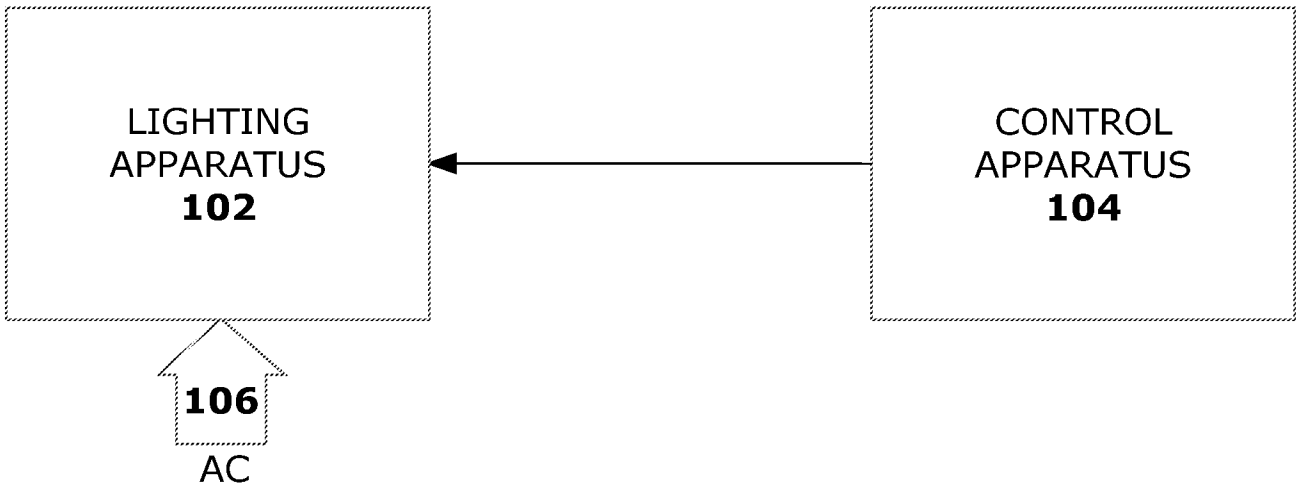
FIGS. 1A, 1B and 1C are system architecture diagrams according to embodiments of the present invention.

FIG. 1A depicts a system architecture diagram according to embodiments of the present invention. As shown, a lighting apparatus 102 is coupled to a control apparatus 104 and receives an AC mains input 106 from an AC mains source (not shown). The lighting apparatus 102 can take numerous forms as one skilled in the art would understand and may comprise an electric circuit that includes a socket for a bulb to be inserted, an electric circuit that includes a modular light engine (for example, an LED light engine) and/or one or more integrated lighting sources such as integrated LED components. Within embodiments of the present invention, the lighting apparatus 102 interfaces with the control apparatus 104 in order to allow a user that interfaces with the control apparatus 104 to control an aspect of the light output from the lighting apparatus 102.

This aspect could include the light intensity, color, color temperature or another aspect that a user may desire to modify concerning the light output. Each aspect that the user of the lighting apparatus 102 desires to modify may have a linear range of values for which the aspect can be adjusted or may have another relationship with a scale (ex. exponential). Further, the values may be continuous or be a discrete set. In other embodiments, an aspect may have a range of values that correspond to set light output results. For example, for color, specific values may correspond to specific colors within a particular spectrum.

Figure 1B:
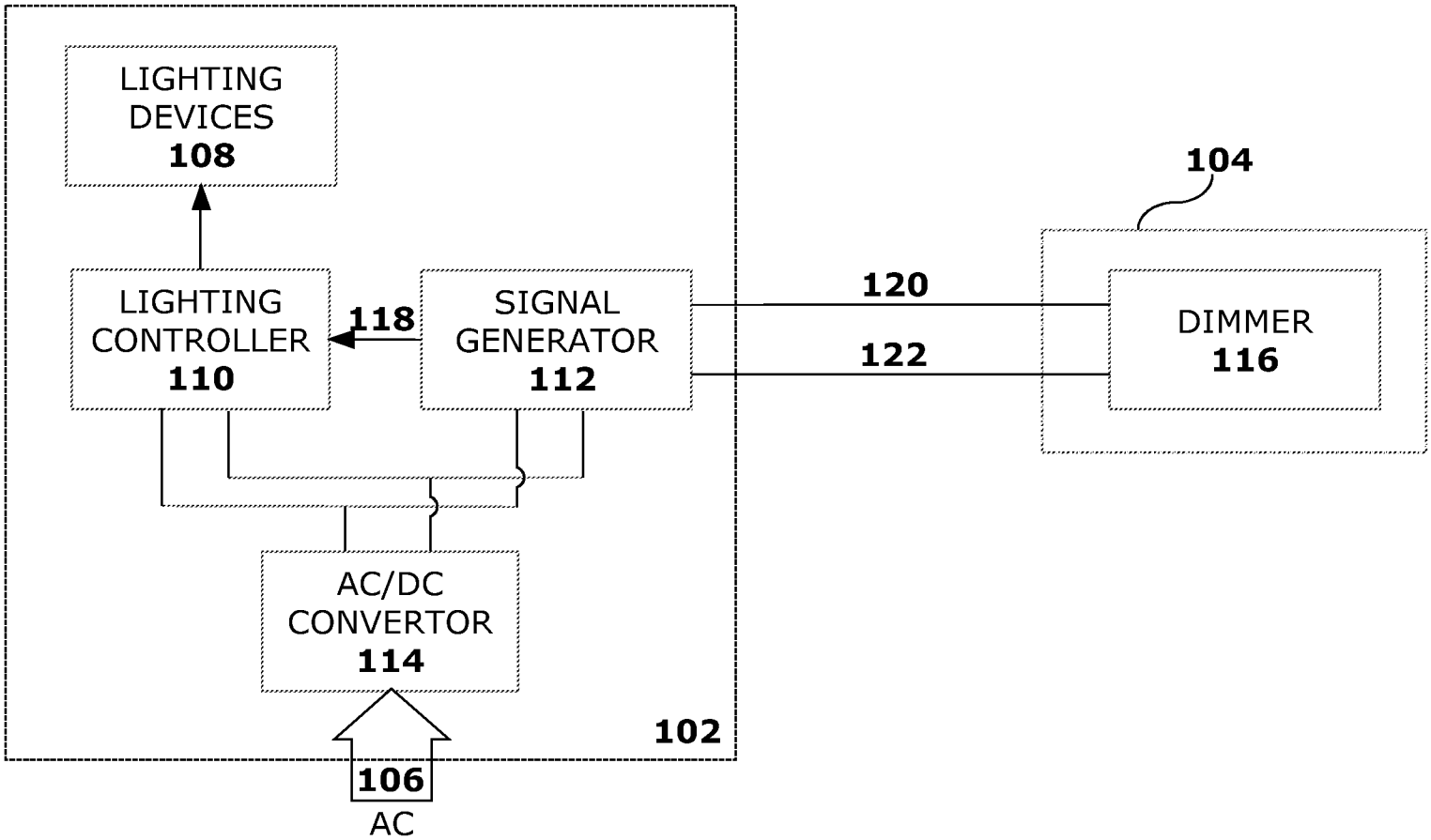
Figure 1C:
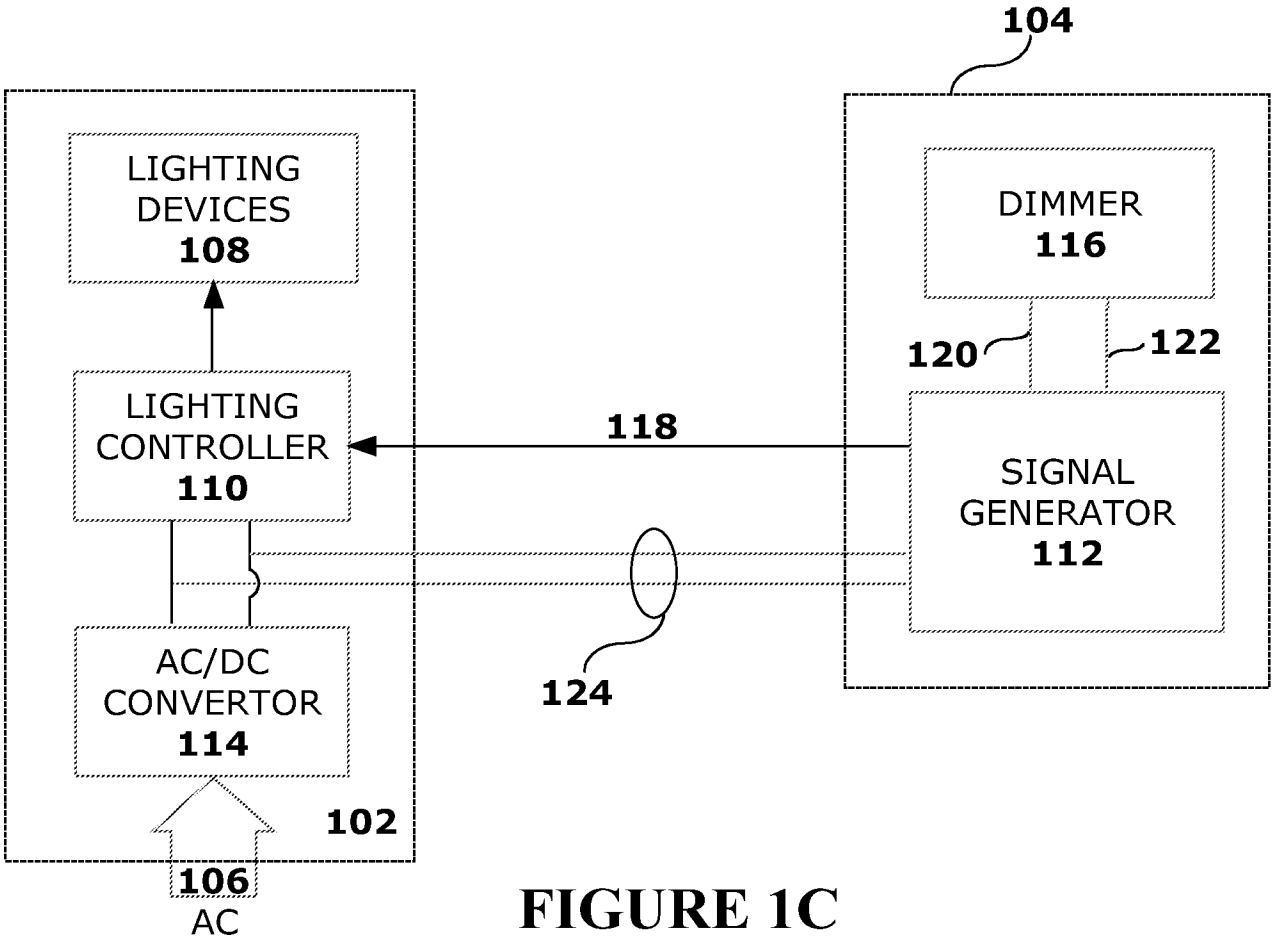

FIGS. 1B and 1C depict system architecture diagrams according to two specific embodiments of the present invention. In one case, as shown in FIG. 1B, the lighting apparatus 102 comprises lighting devices 108, a lighting controller 110, a signal generator 112 (signal generation circuit) and an AC/DC convertor 114 while the control apparatus 104 comprises a dimmer 116. In this case, the lighting devices 108 may comprise devices that operate using DC power, such as LEDs, or devices that operate using AC power, such as fluorescent, halogen, neon or incandescent devices. Both the lighting controller 110 and the signal generator 112 (signal generation circuit) receive DC power from the output of the AC/DC convertor 114. If the lighting devices 108 require DC power, they may receive DC power directly from the AC/DC convertor 114 as controlled by the lighting controller 110 or indirectly through the lighting controller 110. If the lighting devices 108 require AC power, they may receive AC power from the AC mains input 106 as controlled by the lighting controller 110 or through, in the case of fluorescent, a modified AC mains by use of a mechanical or electrical ballast. The lighting devices 108 may also be referred to as a light radiating element of the lighting apparatus 102 and function to radiate light. The light radiating element may be comprised of a plurality of LEDs in certain embodiments or alternatively in a plurality of sets of LEDs that may each be independently controlled by the lighting controller 110. Other power supply distribution architectures may be used in certain implementations of the invention, for example, the power supply distribution architecture illustrated in FIG. 16.

As shown, two lines 120, 122 couple the signal generator 112 in the lighting apparatus 102 to the dimmer 116 in the control apparatus 104. As will be described in detail with reference to FIG. 3, the signal generator 112 in combination with the dimmer 116 operate to generate an output signal 118 indicative or representative of a value corresponding to the state of an interface of the dimmer 116 (i.e. a user setting of the dimmer 116). This user setting or value (present value) of the dimmer 116 corresponds to a desired setting for an aspect of the lighting apparatus 102. For example, a value (setting) of the dimmer 116 may indicate the intensity of light desired to be output from the lighting apparatus 102 and the signal 118 output from the signal generator 112 (signal generation circuit) may represent a value for the intensity of light desired to be output from the lighting apparatus 102. The lighting controller 110 processes the output signal 118 from the signal generator 112 and controls power (DC or AC depending upon the lighting devices) to the lighting devices 108 based at least partially upon the output signal 118.

In another case, as shown in FIG. 1C, the lighting apparatus 102 and control apparatus 104 are similar to that of FIG. 1B, but the signal generator 112 is within the control apparatus 104 rather than the lighting apparatus 102. In this case, three lines 118, 124 couple the lighting apparatus 102 to the signal generator 112 within the control apparatus 104. These three lines include the output signal 118 coupled between the signal generator 112 and the lighting controller 110 as well as DC power/ground lines 124 from the AC/DC convertor 114 to the signal generator 112. The two lines 120, 122 still couple the signal generator 112 and the dimmer 116, but these lines are internal to the control apparatus 104. In one case, the signal generator 112 could be an add-on module to a stand-alone dimmer 116 with lines 120, 122 coupling the components together while lines 118, 124 coupling the signal generator 112 to the lighting controller 110 within the lighting apparatus 102. In some embodiments, instead of using DC power/ground lines 124 to provide DC power to the signal generator 112, a separate DC power source could be within the control apparatus 104 of FIG. 1C, this separate DC power source being a battery, a solar array device or another AC/DC converter coupled to an AC mains source.

In the case of the lighting devices 108 (light radiating element) being LEDs, the lighting controller 110, in some embodiments, may control the operation of the lighting devices 108 using a constant current control circuit such that the lighting controller 110 may selectively adjust the current flowing through one or more series of LEDs in order to achieve the desired light output. In this manner, the lighting controller 110 may independently control a plurality of sets of LEDs that may be included in the light radiating element of the lighting apparatus 102. For example, in the case that the dimmer 116 is used to control the light intensity, the lighting controller 110 may increase or decrease the current flow through one or more of the LEDs as the dimmer setting is increased or decreased respectively and the output signal 118 reflects this change. For the case of color or color temperature adjustments, the lighting controller 110 may selectively increase or decrease current flowing through particular sets of LEDs with particular light spectrum outputs in order to achieve the desired combined color or color temperature. In the case of lighting devices 108 comprising red, green and blue LEDs for example, the lighting controller 110 may selectively adjust current flow through the LEDs of different colors, hence increasing or decreasing the luminance of particular LEDs, in order to achieve a variety of light outputs as dictated by the output signal 118.

In other embodiments, the lighting controller 110 may control the lighting devices 108 (light radiating element) by controlling one or more switching transistors, or a switching element, coupled in series with one or more LEDs between a constant voltage DC power source and a reference ground. In this case, the lighting controller 110 can use Pulse Width Modulation (PWM) to selectively turn on the switching transistors and therefore allow current to flow through the LEDs for a set period of time within a duty cycle. By adjusting the on/off period of time for each set of LEDs, the lighting controller 110 can achieve the desired light output from the light radiating element (lighting devices 108). For example, in the case that the dimmer 116 is used to control the light intensity, the lighting controller 110 may increase or decrease the on time for one or more of the LEDs as the dimmer setting is increased or decreased respectively and the output signal 118 reflects this change. For the case of color or color temperature adjustments, the lighting controller 110 may selectively increase or decrease the on time for particular sets of LEDs with particular light spectrum outputs in order to achieve the desired combined color or color temperature. In this manner, the lighting controller 110 may be operable to independently control each set of LEDs in certain embodiments.

It should be understood that other techniques for controlling the lighting devices 108 may be utilized and the operation of the lighting controller 110 in its response to the output signal 118 should not limit the scope of the present invention. Further, in some cases, there may be a plurality of control apparatus 104 (each with a dimmer) to control a plurality of aspects of the lighting devices 108. For example, there may be a first control apparatus 104 coupled to the lighting controller 110 to control intensity levels of the lighting devices 108 and a second control apparatus 104 coupled to the lighting controller 110 to control color and/or color temperature of the lighting apparatus. Further, if higher accuracy is desired, a plurality of control apparatus that may each comprise a dimmer 116 could control a single aspect such as intensity. In this case, one control apparatus could be used for a coarse adjustment and another control apparatus could be used for a finer adjustment.

The dimmer 116 of FIG. 1B may comprise a number of well-known dimmers, such as a TRIAC dimmer that are typically utilized with current lighting technologies, such as incandescent light bulbs. A TRIAC dimmer is named after an electronic component called a TRIAC (triode for alternating current or bidirectional triode thyristor) that is a component within the TRIAC dimmer. As one skilled in the art would understand, a TRIAC is an electronic component approximately equivalent to two silicon-controller rectifiers (SCRs/thyristors) joined in inverse parallel and with their gates connected together. A TRIAC is a bidirectional electronic switch (hence has no polarity) which can conduct current in either direction when it is triggered (turned on) by applying a sufficient trigger voltage to its gate electrode. It can be triggered by either a positive or negative trigger voltage being applied to its gate electrode. Once triggered, the device continues to conduct until the current through it drops below a certain threshold value, the holding current, such as at the end of a half-cycle of AC main power.

Figure 2:
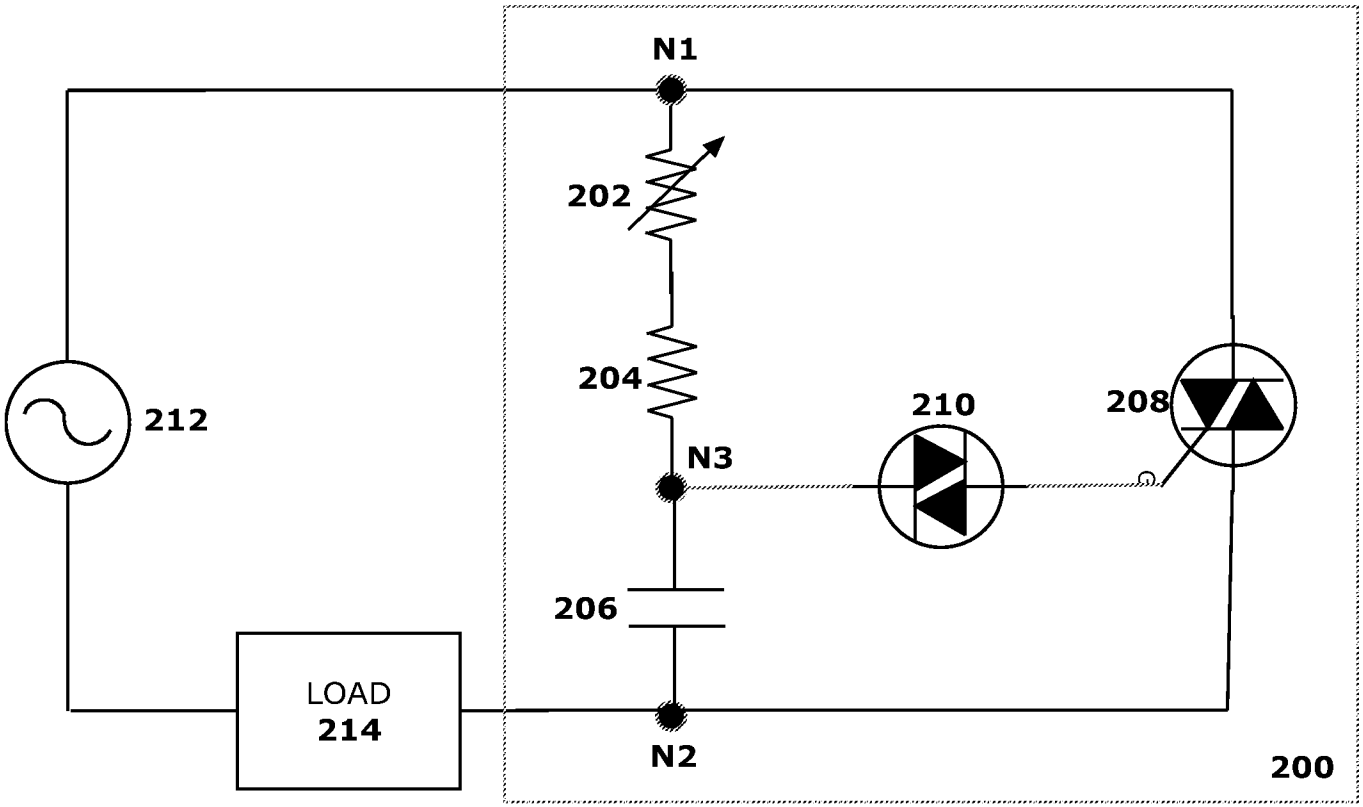
FIGURE 2 (PRIOR ART)
FIG. 2 is a circuit diagram of a well known TRIAC dimmer.

FIG. 2 depicts a sample implementation of a well-known TRIAC dimmer 200. It should be understood that there are numerous designs for dimmers that utilize TRIAC and/or DIAC components and the implementation of FIG. 2 is only meant as one sample implementation. Other implementations of TRIAC dimmers may include additional capacitors in series or utilize other circuit elements to achieve a variable resistance or variable impedance, for example, a transresistance or transimpedance amplifier. Accordingly, as used herein, a TRIAC dimmer should be understood to encompass various implementations of TRIAC dimmers or circuitry to achieve a similar functionality. As will be described herein below, in one embodiment, the dimmer 116 may comprise a circuit similar to the TRIAC dimmer 200 of FIG. 2. In other embodiments, the dimmer 116 may comprise alternative dimmer circuits as may be well-known by one skilled in the art. For example, alternative dimmer circuits may include a variable resistor in series with at least one capacitor that does not include TRIAC or DIAC components. Alternatively, the dimmer 116 may include a transimpedance or transresistance amplifier, as are well known in the art, to provide a variable resistance or impedance rather than a variable resistor in certain implementations.

As shown, the TRIAC dimmer 200 of FIG. 2 comprises a potentiometer (or variable resistor) 202 coupled in series with a resistor 204 and a capacitor 206 between a node N1 and a node N2; a TRIAC 208 coupled in parallel with the resistor/capacitor circuit 202, 204, 206 between the nodes N1, N2; and a DIAC 210 coupled between the gate of the TRIAC 208 and a node N3 between the resistor 204 and the capacitor 206. In normal operation, the nodes N1, N2 of the TRIAC dimmer 200 would be coupled to an AC main 212 and load 214, such as one or more incandescent light bulbs. Other implementations of a TRIAC dimmer may vary and may, for example, include an additional capacitor (not shown) in series with potentiometer 202, between potentiometer 202 and node N1.

In operation, a user adjusts an interface such as dial or slider in order to change the resistance within the potentiometer 202 or more generally to change the value of the interface of the dimmer. In one example, the potentiometer 202 may adjust up to a resistance of 60 kΩ, the resistor 204 may be set at 3.3 kΩ and the capacitor 206 may be set at 100 nF. In this configuration, the resistor/capacitor circuit 202, 204, 206 delays the turn on of the TRIAC until the voltage at node N3 reaches the breakdown voltage of the DIAC 210. Once the breakdown voltage of the DIAC 210 is reached, the voltage drop across the DIAC 210 dramatically decreases and the voltage on the gate electrode of the TRIAC 208 exceeds the trigger voltage of the TRIAC 208, hence turning the TRIAC 208 on. Increasing the resistance of the potentiometer 202 increases the turn-on delay which decreases the on-time or "conduction angle" of the TRIAC 208. This reduces the average power delivered to the load 214. While the input voltage in this TRIAC dimmer 200 will be a full sinusoid, the output voltage will comprise a sinusoidal waveform that has segments with zero voltage, this occurring during the time segments that the TRIAC 208 is turned off. The off-time of the TRIAC 208 represents the delay caused by the resistor/capacitor circuit 202, 204, 206 in triggering the DIAC 210 to turn on, which subsequently triggers the TRIAC 208 to turn on. In some embodiments, the trigger voltage at node N2 may be approximately 25V, though this depends upon the electronic components utilized.

As will be described in detail with reference to FIG. 3, some embodiments of the present invention utilize an off-the-shelf dimmer, such as the TRIAC dimmer 200 of FIG. 2. In these cases, rather than coupling the dimmer to an AC source as is typical with a TRIAC dimmer, the dimmer is instead coupled to low voltage components and utilized for its potentiometer and capacitor circuit. By ensuring that the instantaneous voltage applied to the dimmer is never sufficient to turn on any TRIAC and/or DIAC components within the TRIAC dimmer, the dimmer effectively becomes a potentiometer coupled in series with a capacitor and could be implemented as such in certain embodiments (i.e. not have the additional TRIAC circuitry). With additional circuitry coupled to the TRIAC dimmer, selections made on the potentiometer by a user can be interpreted and control of a lighting apparatus can be achieved using the TRIAC dimmer as will be described in detail below.

Off-the-shelf dimmers come in large numbers of different form factors, designs and colors. Further, they can be incredibly low cost due to the high volume production that they currently are part of. Embodiments of the present invention that utilize off-the-shelf dimmers are leveraging these advantages and allowing for a wide selection of widely available dimmers to interoperate with a lighting apparatus, such as an LED lighting apparatus.

Figure 3:
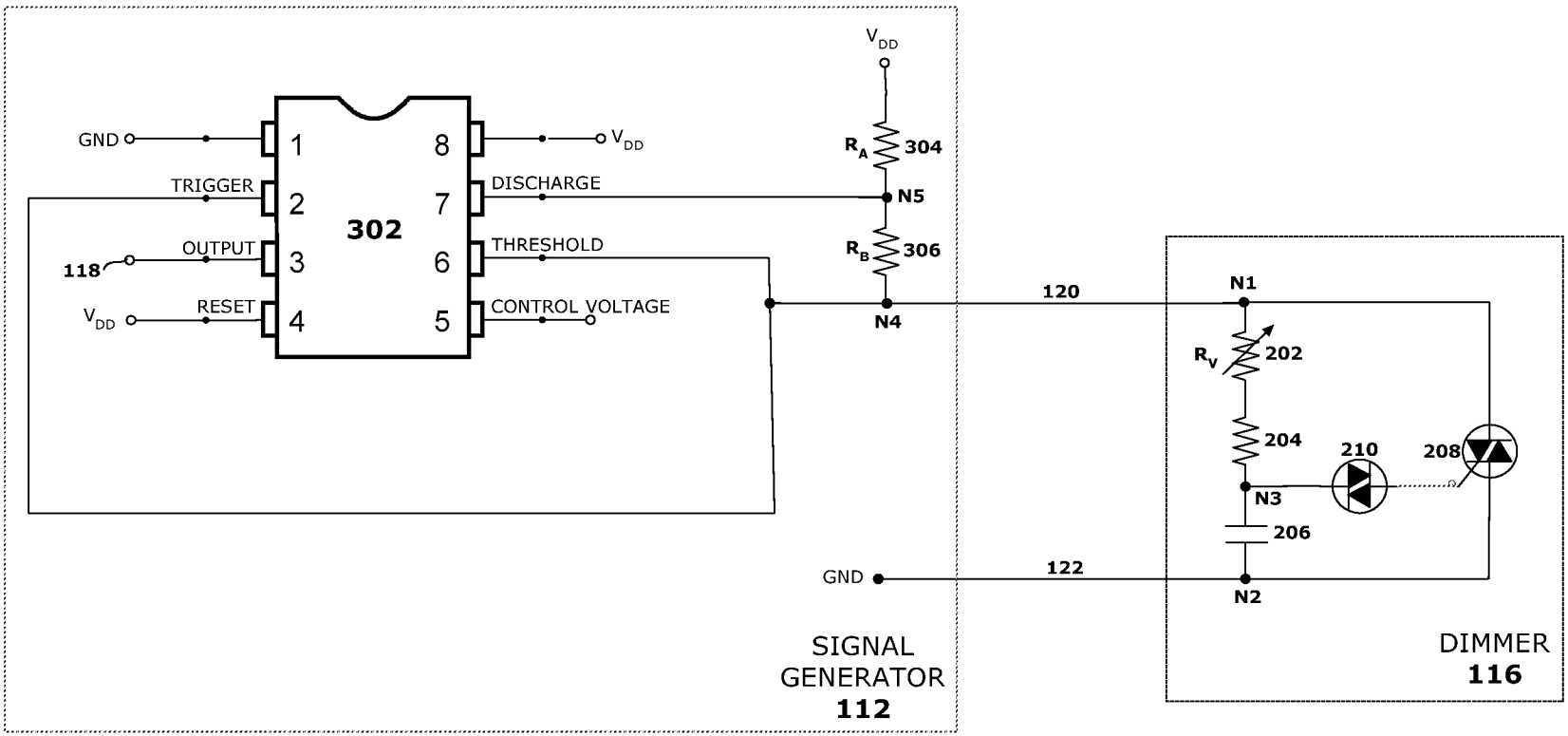
FIG. 3 is a circuit diagram of a signal generator and TRIAC dimmer according to a first embodiment of the present invention.

FIG. 3 is a circuit diagram of the signal generator 112, also referred to as the signal generation circuit 112, and the dimmer 116 according to a first embodiment of the present invention. As shown in FIG. 3, the signal generator 112 comprises a component 302, a first resistor 304 ($R_A$) and a second resistor 306 ($R_B$). The component 302 of FIG. 3, according to some embodiments of the present invention, comprises a 555 timer integrated circuit such as ICM7555CD/01 manufactured by NXP Semiconductor of Eindhoven, The Netherlands. It should be understood that other components with similar functionality could be utilized to implement the present invention and the functionality of the component 302 may be implemented by discreet components, software and/or firmware rather than a single integrated circuit.

As shown, the component 302 comprises eight terminals (numbered 1-8). Terminals 1 and 8 are inputs for reference ground GND and DC supply voltage $V_{DD}$ respectively. Reference ground GND and the DC supply voltage $V_{DD}$ are supplied directly from the AC/DC convertor 114 in the embodiment of FIG. 1B and are supplied via DC supply/ground lines 124 in the embodiment of FIG. 1C. In the embodiment of FIG. 3, terminal 4 of the component 302 is a reset terminal and is set to the supply voltage $V_{DD}$ while terminal 5 is a control voltage terminal that may or may not be utilized to adjust voltage thresholds for switching as will be described herein below. Terminals 2, 3, 6 and 7 of the component 302 comprise a trigger terminal, an output terminal, a threshold terminal and a discharge terminal respectively.

The dimmer 116, in this embodiment, comprises the TRIAC dimmer 200 of FIG. 2 and like components are numbered with the same references. The dimmer 116 is coupled to the signal generator 112 at nodes N1 and N2 via lines 120 and 122 respectively. In certain embodiments, node N1 may be referred to as a connection node. Line 120 is coupled to a node N4 described below and line 122 is coupled to the reference ground GND within the signal generator 112 or may otherwise be coupled to the reference ground GND that the signal generator 112 is utilizing. In an alternative embodiment, line 122 may be coupled to the AC/DC convertor 114 in order to receive the reference ground GND. A capacitor with a high capacitance or an Electro-Static Discharge (ESD) blocker could further be coupled to line 120.

In the embodiment of FIG. 3, the first resistor 304 ($R_A$) is coupled in series with the second resistor 306 ($R_B$) between the supply voltage $V_{DD}$ and the node N4, node N4 being coupled to the node N1 within the dimmer 116 via line 120. The trigger terminal (terminal 2) and the threshold terminal (terminal 6) of the component 302 are coupled together and further coupled to the node N4 while the discharge terminal (terminal 7) of the time component 302 is coupled to a node N5 defined between the first and second resistors 304, 306.

With a standard DC supply voltage $V_{DD}$ (for example: 3 or 5V), the voltage at node N3 within the dimmer 116 will never be sufficient to turn on the DIAC 210 or the TRIAC 208. In particular, the voltage at node N3 will always be below the breakdown voltage for the DIAC 210 and the voltage at the gate electrode of the TRIAC 208 will never reach the trigger voltage for the TRIAC 208. A breakdown voltage for a DIAC 210 can be approximately 25V and a trigger voltage for a TRIAC 208 within a TRIAC dimmer may similarly be approximately 25V. Although the actual supply voltages may be different in a variety of embodiments of the present invention, the voltages applied to the DIAC and/or TRIAC within the dimmer 116 according to embodiments of the present invention are not sufficient to turn the components on.

Hence, in analyzing the circuit of FIG. 3, the DIAC 210 and the TRIAC 208 can be assumed to be open circuits at all times. The use of the dimmer 116 in the circuit of FIG. 3 is not to modify an AC sinusoid as it is normally used, but instead to allow for the potentiometer 202 and the capacitor 206 to be included within an overall oscillation circuit that includes the component 302 and the first and second resistors 304, 306. As will be described in detail, an oscillation signal with an adjustable frequency can be generated at the output terminal (terminal 3) of the component 302 using the circuit of FIG. 3, the oscillation signal having a frequency (and period) dictated in part by the resistance set at the potentiometer 202. It is noted that the resistance of the potentiometer 202 cannot easily be measured directly with an ohmmeter external to the dimmer 116 since the potentiometer 202 is embedded in series with the capacitor 206.

The circuit of FIG. 3 is designed to enable the component 302 to operate within an astable vibrator oscillation mode. The discharge terminal (terminal 7) of the component 302 has two states depending upon the voltage on the trigger and threshold terminals (terminals 2 & 6), node N4 within FIG. 3. In a first state, when the voltage on node N4 becomes one third of the supply voltage $V_{DD}$ or less, the discharge terminal (terminal 7) becomes an open circuit. In a second state, when the voltage on node N4 becomes two thirds of the supply voltage $V_{DD}$ or greater, the discharge terminal (terminal 7) becomes coupled to the reference ground GND. This back and forth transition from the reference ground GND and an open circuit within the discharge terminal (terminal 7) allows the capacitor 206 within the dimmer 116 to charge and discharge at a rate dictated by the resistance of the first and second resistors 304, 306 and the potentiometer 202. When the discharge terminal (terminal 7) is an open circuit, the capacitor 206 will charge and the voltage at node N4 will increase based upon the voltage divider created with the combined resistance of resistors 304, 306 and combined resistance of the potentiometer 202 and the resistor 204. When the discharge terminal (terminal 7) is coupled to the reference ground GND, the capacitor will discharge and the voltage at node N4 will decrease based upon the voltage divider created with the resistance of the second resistor 306 and combined resistance of the potentiometer 202 and the resistor 204.

In the first state:

$$V_4 = V_C + (V_{DD} - V_C)\frac{R_V}{R_V + R_A + R_B}$$

where $V_4$ is the voltage on node N4; $V_{DD}$ is the supply voltage; $V_C$ is the voltage on node N3; and $R_A$, $R_B$ and $R_V$ are the resistances on resistor 304, resistor 306 and potentiometer 202 respectively. In this equation and the equation for the second state, the resistance of resistor 204 within the dimmer 116 is ignored for simplicity since it is generally relatively small compared to the resistance on the potentiometer 202.

In the first state, the voltage at node N3 ($V_C$) will increase as the capacitor 206 charges, thus increasing the voltage at node N4 ($V_4$). Once the voltage at the node N4 ($V_4$) increases to two thirds of the supply voltage $V_{DD}$ (or another threshold as could be set), the discharge terminal (terminal 7) within the component 302 switches and is coupled to the reference ground GND (the second state).

In the second state:

$$V_4 = V_C\left(\frac{R_V}{R_V + R_B}\right)$$

In the second state, the voltage at node N3 ($V_C$) will decrease as the capacitor 206 discharges, thus decreasing the voltage at node N4 ($V_4$). Once the voltage at the node N4 ($V_4$) decreases to one third of the supply voltage $V_{DD}$ (or another threshold as could be set), the discharge terminal (terminal 7) within the component 302 switches and is open circuited (the first state). In some embodiments, the threshold voltage levels on node N4 that trigger the switch from the first state to the second state and back can be adjusted by adjusting a voltage applied to the control voltage terminal (terminal 5) on the component 302 in FIG. 3.

The output terminal (terminal 3) within the timing component 302 outputs the output signal 118 which is a representation of the switching of the discharge terminal (terminal 7) within the component 302 between the first and second states. When the discharge terminal is in the first state, the output signal 118 is a high voltage. When the discharge terminal is in the second state, the output signal 118 is a low voltage. Therefore, as the discharge terminal switches between the first and second states, the output signal 118 becomes an oscillation signal with an output frequency set by the ratio of the resistances $R_A$, $R_B$, $R_V$.

One can calculate the frequency of the output signal as it relates to the resistances $R_A$, $R_B$, $R_V$. In the specific example implementation of FIG. 3, while ignoring the resistor 204, the time $T_C$ required for the node N4 to charge to two thirds of the supply voltage $V_{DD}$ and the time $T_D$ required for the node N4 to discharge to one third of the supply voltage $V_{DD}$ are defined by the following equations:

$$T_C = C(R_A + R_B + R_V)\ln\left(\frac{1-X}{1-Y}\right) \quad T_D = C(R_B + R_V)\ln\left(\frac{Y}{X}\right)$$

where:

$$X = \frac{2}{3} - \frac{R_V}{3(R_A + R_B)};\ Y = \frac{1}{3} + \frac{R_V}{3R_B}$$

and C is the capacitance of capacitor 206.

Therefore, the total time to charge and discharge can be represented by:

$$T_C + T_D = C(R_A + R_B + R_V)\ln\left(\frac{1-X}{1-Y}\right) + C(R_B + R_V)\ln\left(\frac{Y}{X}\right)$$

and the frequency of the output signal 118 can be calculated as:

$$F = \frac{1}{T_C + T_D}.$$

In order for the architecture of FIG. 3 to operate properly, the values of the resistances $R_A$, $R_B$, $R_V$ must follow a particular relationship to ensure that the node N4 does not instantly change to less than one third of the supply voltage $V_{DD}$ when the circuit switches from the first state to the second state. The relationship is:

$$R_V < \frac{R_B(R_A + R_B)}{R_A + 2R_B}$$

Figure 10:
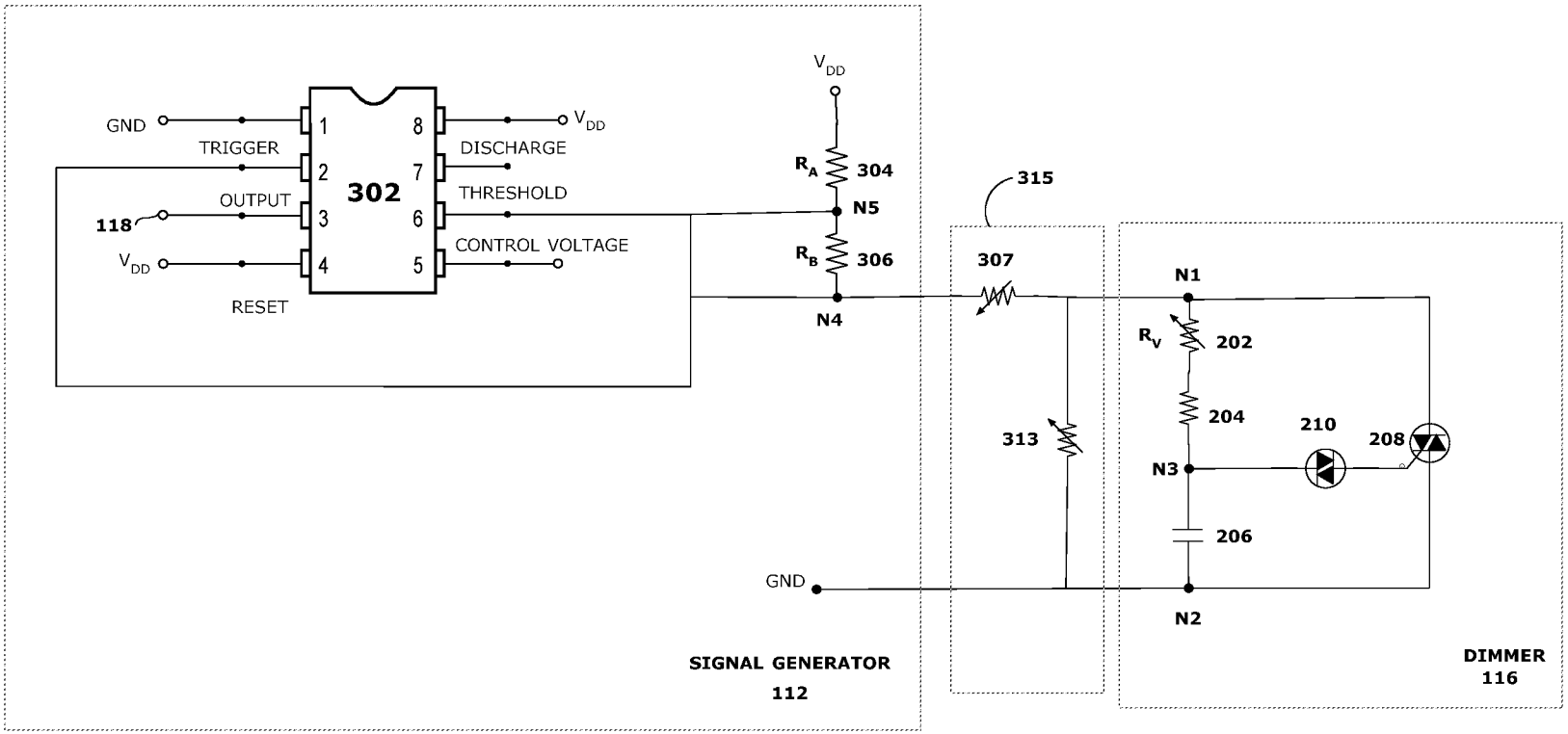
FIG. 10 is a circuit diagram of a signal generator and TRIAC dimmer according to a first embodiment of the present invention having an impedance matching circuit.

If the dimmer 116 is an off-the-shelf TRIAC dimmer, the range of resistance within the potentiometer 202 will be difficult to modify. Therefore, when designing the circuit of FIG. 3, the selection of the resistances $R_A$, $R_B$ for resistors 304,306 should be done to maintain the above relationship for the various potential range of $R_V$. In one particular example, in which the potentiometer has a range of 3 kΩ to 60 kΩ, the resistances $R_A$, $R_B$ can both have values of 100 kΩ. This relationship can also be adjusted by applying a voltage to the control voltage terminal (terminal 5) within the component 302 and therefore changing the threshold voltages at which the component 302 switches from the first state to the second state and vice versa. When embodiments of the invention employing an impedance matching element, such as the embodiment illustrated in FIG. 10, are used the impact of the impedance matching element must also be accounted to ensure similar operation.

In the embodiment of the present invention of FIG. 3, the resistors 304,306 are fixed resistors while the potentiometer 202 has a variable resistance. As the resistance on the potentiometer 202 is changed by a user of the dimmer 116, the frequency (and period) of the output signal 118 will change in response. The output signal 118, as depicted in FIGS. 1B and 1C, can be received by the lighting controller 110. The lighting controller 110, according to embodiments of the present invention, can detect the frequency of the output signal 118 or data related to the frequency (i.e. the period). For example, in some embodiments, the lighting controller 110 can measure the time between changes from high to low or low to high in the output signal 118. In other embodiments, the duration of a high state, low state or total duty cycle may be measured. In some embodiments, the lighting controller 118 could measure the duration period of multiple cycles of high and/or low states to achieve additional accuracy and granularity of the setting of the potentiometer 202 within the dimmer 116. The lighting controller 118, using the data related to the frequency of the output signal 118, can generate information related to the setting of the potentiometer 202 within the dimmer 116, hereinafter referred to as dimmer information. The period as used herein, should be construed broadly to include data related to the period including fractions and multiples of the period and generally include data related to the frequency or period.

The dimmer information may be generated in a number of ways. In some embodiments, the lighting controller 110 can use a calibration table to determine which of the data related to the frequency of the output signal 118 corresponds to what corresponding dimmer information. In other cases, the lighting controller 110 may utilize a formula to generate dimmer information associated with a range for the data related to the frequency of the output signal 118. Other techniques for converting the data related to the frequency of the output signal 118 to the dimmer information should be understood and the actual method used should not limit the scope of the present invention.

The lighting controller 110 can utilize the dimmer information to control an aspect of the lighting devices 108. In some embodiments, the lighting controller 110 can use the dimmer information to generate an intensity level signal to manage the intensity of the lighting devices 108. The intensity level signal may take a number of forms. In the case that the lighting devices 108 are LEDs, the intensity level signal may comprise a PWM signal that selectively turns on/off the LEDs for a particular amount of time within a duty cycle. In other cases, the intensity level signal may be used to adjust the current flow through the lighting devices 108. In yet other embodiments, the intensity level signal may be used to adjust the power to the lighting devices 108 in other manners. For example, in the case that the lighting devices 108 are AC devices such as incandescent, halogen or fluorescent devices, the intensity level signal may adjust an AC signal being applied to the lighting devices 108.

In other embodiments, the lighting controller 110 may use the dimmer information to control other aspects of the lighting devices, such as the color and/or color temperature of the lighting devices 108. For example, in the case of the lighting devices 108 comprising LEDs, the lighting controller 110 may turn on/off a select set of the LEDs for a particular time period within a duty cycle in response to the dimmer information in order to generate a particular light spectrum in the light output from the lighting apparatus 102. In some particular case, if the dimmer information indicates that the lighting apparatus 102 should emit more of a red spectrum, the lighting controller 110 may turn on additional red LEDs or turn on a set of red LEDs for a longer period of time during the duty cycle. It should be understood that, in a scenario with various sets of LEDs of different colors and/or color temperatures, by adjusting which sets of LEDs are turned on and for how long each set of LEDs are turned on, the lighting controller 110 can change the color and/or color temperature of the resulting light output from the lighting apparatus 102. In other embodiments, the lighting controller may adjust the current flow through a plurality of sets of LEDs in order to adjust the resulting spectrum of the light output. As the current level is increased to a particular set of LEDs, the luminance of those LEDs will typically increase, assuming that it does not exceed the maximum allowable current. Similarly, as the current level is decreased to a particular set of LEDs, the luminance of those LEDs will typically decrease.

It should be understood that the above description of the lighting controller 110 utilizing the dimmer information should not limit the scope of the present invention. In some embodiments, the lighting controller 110 does not convert the data related to the frequency of the output signal 118 to dimmer information but instead directly interprets it into one or more signals that can be used to control the lighting devices. For example, in some embodiments, the lighting controller 110 may correlate particular data related to the frequency of the output signal 118, for example, the period of the output signal 118, into particular intensity level signals and/or signals that can be used to control the color and/or color temperature of the lighting apparatus 102.

It should be understood that the above description related to FIG. 3 is directed to a particular design of the dimmer 116 and the above defined equations would change depending upon the specific circuits within the dimmer 116. In particular, an alternative design for the dimmer 116 would change the calculation of the frequency for the output signal 118 and would also change the required relationship with the values of the resistors 304,306. In some cases, the circuit within the signal generator 112 would need to be adjusted to allow for the modified design for the dimmer 116.

Figure 8:
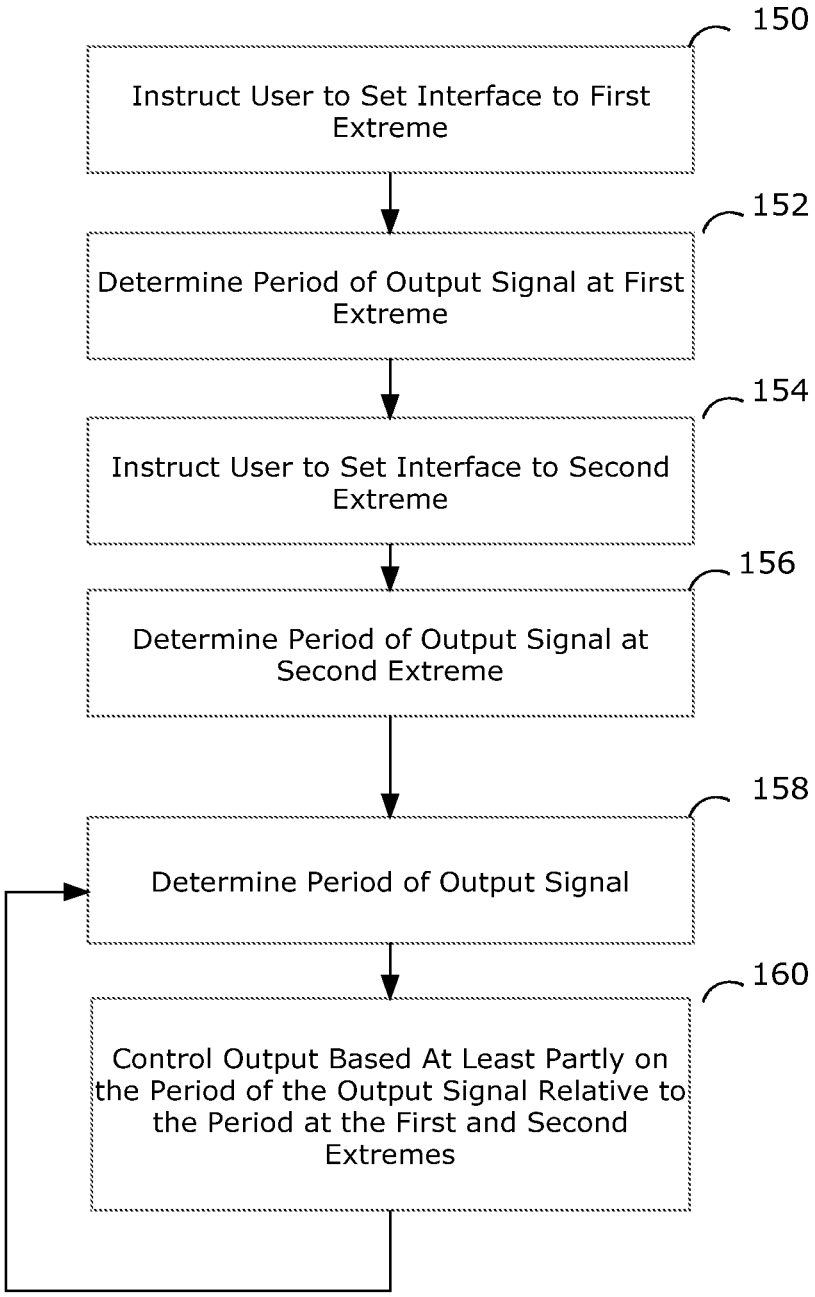
FIG. 8 is a flowchart illustrating certain steps for one method of calibrating a lighting controller for use with a particular dimmer.

In some embodiments, the lighting controller 110 can detect the minimum and maximum frequencies that the output signal 118 can be within. This can be accomplished by having a user of the dimmer 116 adjust the potentiometer 202 from first and second extreme levels. By detecting data related to the frequency of the output signal 118 at the minimum and maximum levels, the lighting controller 110 can then utilize this data to establish a range of setting for controlling the lighting devices 108. For example, in one case, the lighting controller 110 could set a linear correlation between the minimum and maximum settings and adjust an aspect of the lighting devices 108 linearly depending upon the data related to the frequency of the output signal 118 as it relates to the maximum and minimum levels. Other non-linear relationships could also be used. Such a calibration procedure could be communicated to an end user of the lighting apparatus 102 and/or control apparatus 104 by way of a diagram or written instructions to connect the dimmer, enable the lighting apparatus 102 and then adjust the dial within the dimmer to each of its extremes slowly enough for the lighting controller 110 to capture the correct limits Additional details of particular embodiments or methods that may be used to calibrate the lighting controller 110 to a particular dimmer 116 are described below with reference to FIGS. 8 and 9. These calibrations procedures may allow the lighting controller 110 to be used effectively with a variety of dimmers having different properties.

Figure 4:
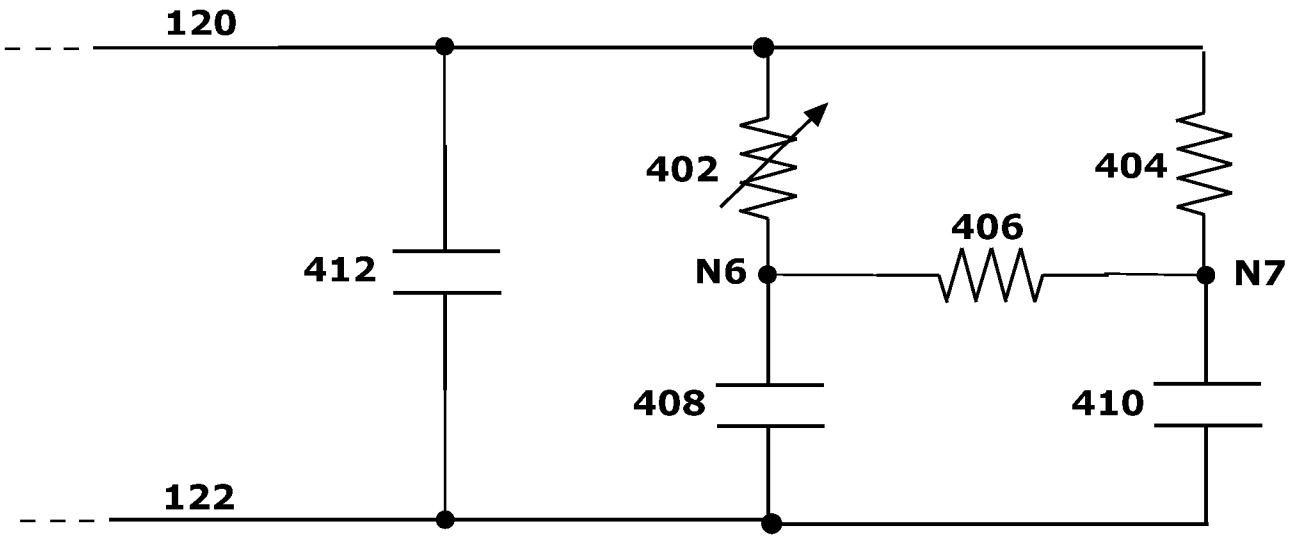
FIG. 4 is a simplified circuit diagram of the linear components of an alternative TRIAC dimmer, excluding the DIAC and TRIAC components.

One example alternative dimmer design that is within a 6621-W dimmer manufactured by Leviton Manufacturing Corporation of Melville, N.Y., U.S.A. is depicted in FIG. 4. The design illustrated in FIG. 4 eliminates the TRIAC and DIAC circuit for simplicity since the operation of the present invention ensures that these components are not relevant as both components remain off. As shown, a potentiometer 402 is coupled between the line 120 and a node N6 while a first resistor 404 is coupled between the line 120 and a node N7. A second resistor 406 is coupled between nodes N6 and N7. Line 122 is coupled to first and second capacitors 408,410 which are further coupled to the nodes N6 and N7 respectively. There is also an additional capacitor 412 coupled between the line 120 and the line 122.

In one particular implementation, the values of the linear components within the dimmer of FIG. 4 are: potentiometer 402 of 6 to 154 kΩ; first resistor 404 of 92 kΩ; second resistor 406 of 390 kΩ; first capacitor 408 of 68 nF; second capacitor 410 of 47 nF; and additional capacitor 412 of 100 nF. In this particular configuration, it has been tested that when the dimmer of FIG. 4 is implemented as dimmer 116 within a circuit similar to FIG. 3, the resistors 304,306 can both be a value of 100 kΩ. In this set-up, the frequency of the output signal 118 adjusts between approximately 20 to 30 Hz.

Figure 5A:
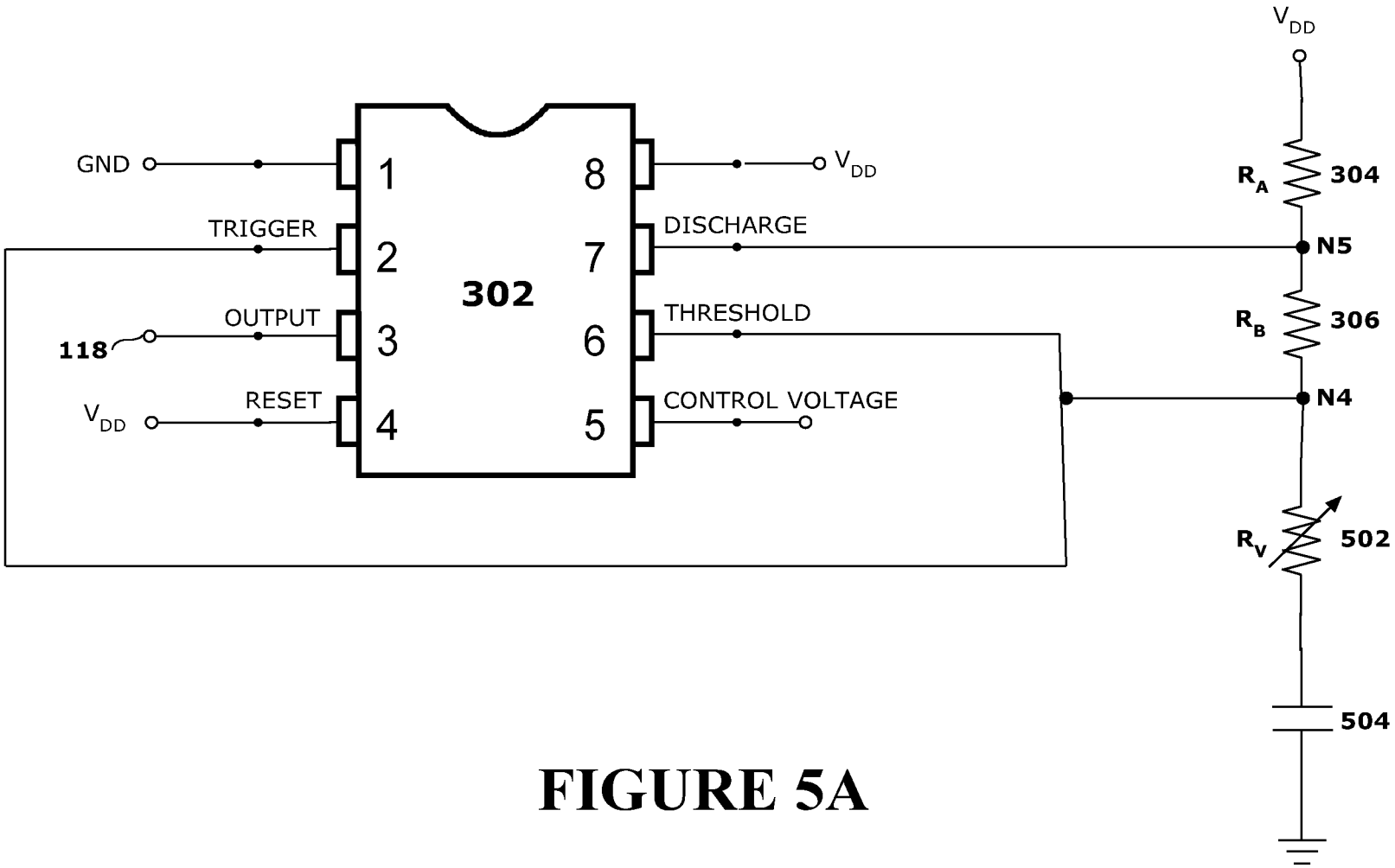
FIGS. 5A and 5B are circuit diagrams of lighting control apparatus according to alternative embodiments of the present invention.
Figure 5B:
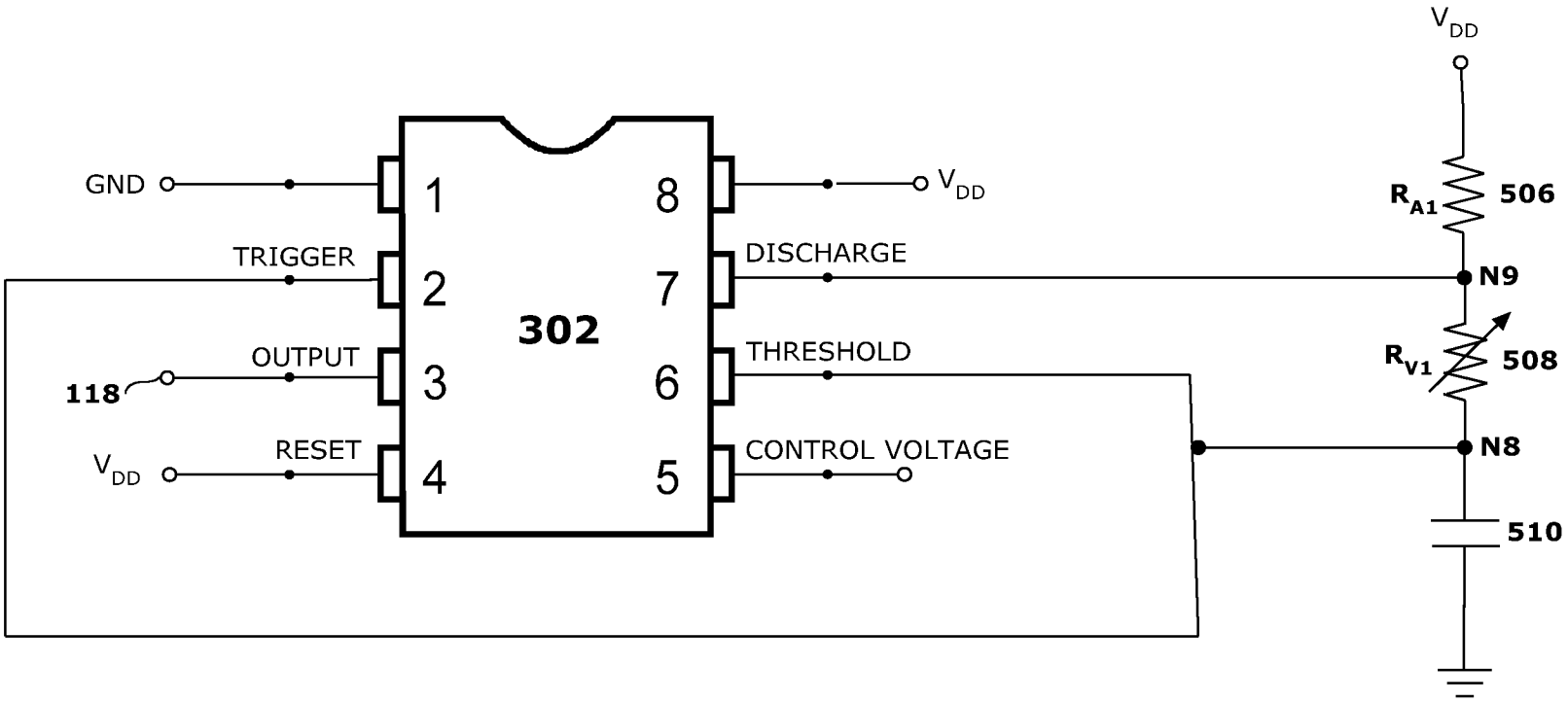

Although the above description includes off-the-shelf TRIAC dimmers within the control apparatus of the present invention, it should be understood that alternative circuitry could be generated that does not use an off-the-shelf TRIAC dimmer while still gaining at least some of the benefits of the present invention. FIGS. 5A and 5B are circuit diagrams of lighting control apparatus 104 according to two particular alternative embodiments of the present invention that do not use off-the-shelf TRIAC dimmers.

As depicted, the lighting control apparatus of FIG. 5A is similar to the circuit of FIG. 3 with like components being marked with the same references. Instead of the dimmer 116 within FIG. 3, the circuit of FIG. 5A has a potentiometer 502 coupled in series with a capacitor 504 between node N4 and the reference ground GND. This circuit is effectively the component equivalent of FIG. 3 with the resistor 204, TRIAC 208 and DIAC 210 removed and may be implemented directly in certain embodiments of the invention in place of a dimmer having TRIAC circuitry. Since the circuit is equivalent, the operation of the circuit is equivalent and the formula for the frequency of the output signal 118 is the same as indicated above for FIG. 3.

The lighting control apparatus of FIG. 5B includes the component 302 which is used similar in function to the circuit of FIG. 3. As depicted, the circuit of FIG. 5B further comprises a resistor 506 coupled in series with a potentiometer 508 and a capacitor 510 between the supply voltage $V_{DD}$ and the reference ground GND. As shown, a node N8 between the potentiometer 508 and the capacitor 510 is coupled to the threshold terminal (terminal 6) and the trigger terminal (terminal 2) of the component. Further, a node N9 between the resistor 506 and the potentiometer 508 is coupled to the discharge terminal (terminal 7) of the component 302.

In the configuration of FIG. 5B, the component 302 generates an output signal 118 similar to the output signal described above with reference to FIG. 3. In particular, the output signal 118 can be used in a similar manner by the lighting controller 110 with the frequency of the output signal 118 being dependent at least partially on the resistance of the potentiometer 508, the potentiometer 508 being adjusted by a user of the control apparatus. The formula for the frequency F of the output signal in this particular configuration is:

$$F = \frac{1.38}{(R_{A1} + 2R_{V1})C}$$

where $R_{A1}$ is the resistance of resistor 506, $R_{V1}$ is the resistance of the potentiometer 508 and C is the capacitance of capacitor 510.

It should be understood that the control apparatus of FIGS. 5A and 5B are only two particular examples of implementations of the present invention not utilizing an off-the-shelf TRIAC dimmer. Other circuits that can utilize a potentiometer to allow for the adjusting of a frequency for an output signal can be used. For instance, the component equivalent of well-known TRIAC dimmers with the TRIAC and DIAC components removed could be used along with a component similar to that of component 302 to generate an output signal of a frequency that is dependent at least partially on the setting of a potentiometer.

It should further be understood that the use of the component 302 within the circuits of FIGS. 3, 5A and 5B could be replaced with discrete components that operate in a similar fashion. For example, one skilled in the art would understand equivalent circuits to replicate the functionality of a 555 Timer. These equivalent circuits for the time component could be used to create a functionally similar circuit to the circuits of FIGS. 3, 5A and 5B.

In the system architectures depicted in FIGS. 1B and 1C, the lighting apparatus 102 and the control apparatus 104 are coupled together by fixed DC lines (120,122 in the case of FIG. 1B and 118,124 in the case of FIG. 1C). It should be understood that in alternative embodiments, the lighting apparatus 102 and the control apparatus 104 may communicate wirelessly as will be described herein below with reference to FIG. 6A or may communicate over AC lines as described herein below with reference to FIG. 6B.

Figure 6A:
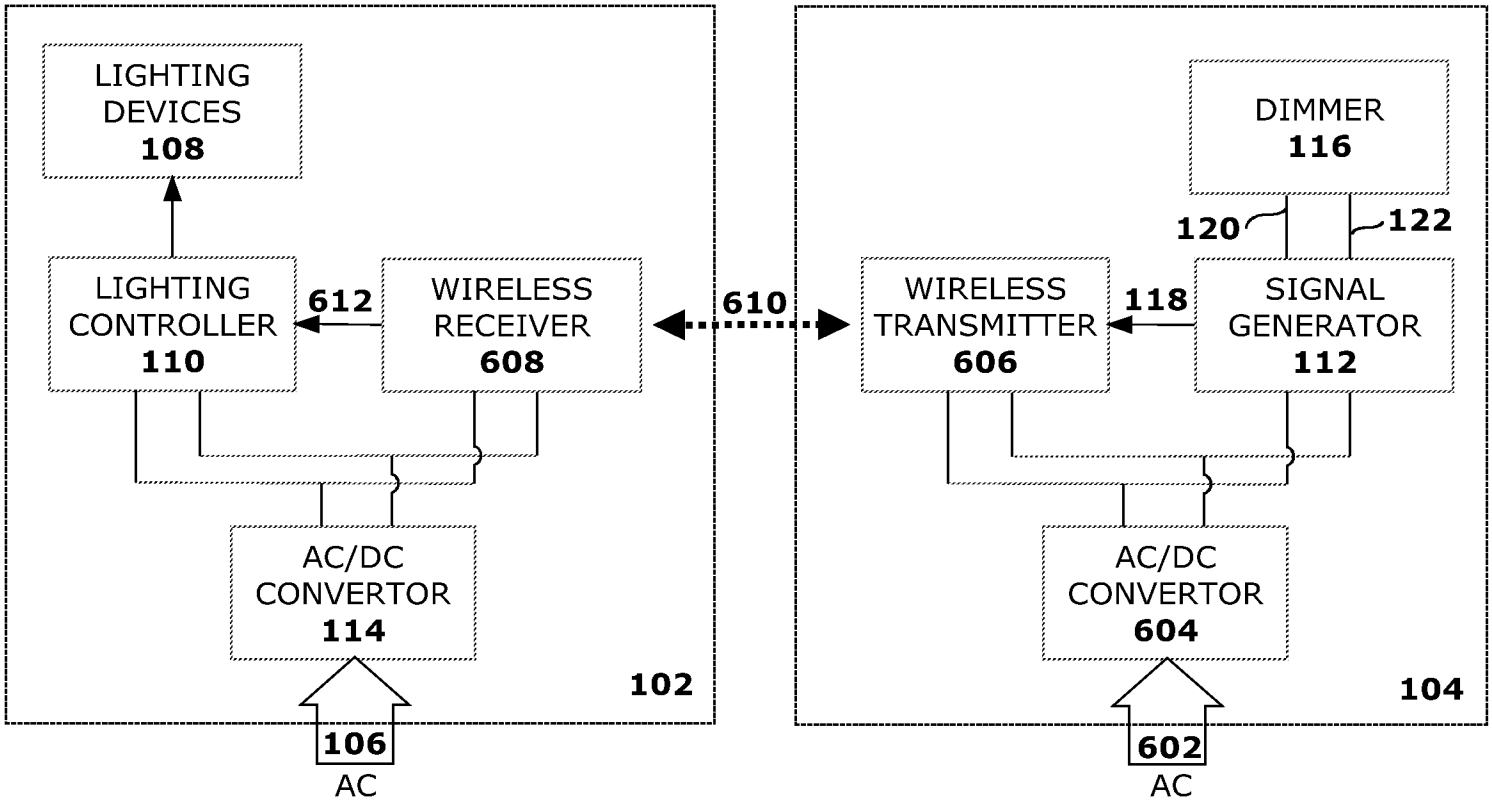
FIGS. 6A and 6B are system architecture diagrams according to embodiments of the present invention using wireless and AC wire coupling technology for communication respectively.

FIG. 6A is a system architecture diagram according to embodiments of the present invention using wireless technology for communication. The architecture of FIG. 6A is a modified version of the architecture of FIG. 1C and therefore like components are marked with the same references. Within FIG. 6A, the control apparatus 104 has a separate AC mains input 602 and does not receive DC power through DC power/ ground lines 124. Instead, the control apparatus 104 of FIG. 6A comprises an AC/DC convertor 604 which supplies DC power to the circuit comprising the signal generator 112 and the dimmer 116. Alternatively, the AC mains input 602 and AC/DC convertor 604 could be replaced with a separate DC power source such as a battery or a solar array device. The control apparatus 104 of FIG. 6A further comprises a wireless transmitter 606 that receives DC power from the AC/DC converter 602 (or the separate DC power source) and the output signal 118 from the signal generator 112.

Within FIG. 6A, the lighting apparatus comprises the AC/DC convertor 114, the lighting controller 110 and the lighting devices 108 similar to that depicted in FIG. 1C but the lighting apparatus further comprises a wireless receiver 610 that receives DC power from the AC/DC convertor 114.

In operation, the wireless transmitter receives the output signal 118 from the signal generator 112 and transmits a wireless signal 610 to the wireless receiver 608, the wireless signal 610 incorporating information related to the output signal 118. In one embodiment, the wireless transmitter 606 is an FSK transmitter that modulates a higher frequency pilot signal using the relatively low frequency output signal 118. In other embodiments, the wireless transmitter 606 may regenerate a new signal within a wireless standard such as SigBe, Bluetooth, WiFi, WiMax, CDMA, GSM, etc. that conveys information related to the output signal 118 such as data related to its frequency. The wireless receiver 608 in operation receives the wireless signal 610 and may modify the signal. For instance, the wireless receiver 608 may demodulate the output signal 118 and effectively regenerate it as signal 612 for forwarding to the lighting controller 110. In other embodiments, the wireless receiver 608 may interpret information within the wireless signal to generate the signal 612 for forwarding to the lighting controller 110. In yet other embodiments, the wireless receiver 608 may remove overhead attached by the wireless transmitter 606 and forward the content or a representation thereof as signal 612 to the lighting controller 110. In all cases within the architecture of FIG. 6A, the wireless transmitter 606 and the wireless receiver 608 work together to wirelessly communicate information within the output signal 118 to the lighting controller 110. It should be understood that one skilled in the art may contemplate other implementations for communicating information from the output signal 118 to the lighting controller 110.

Figure 6B:
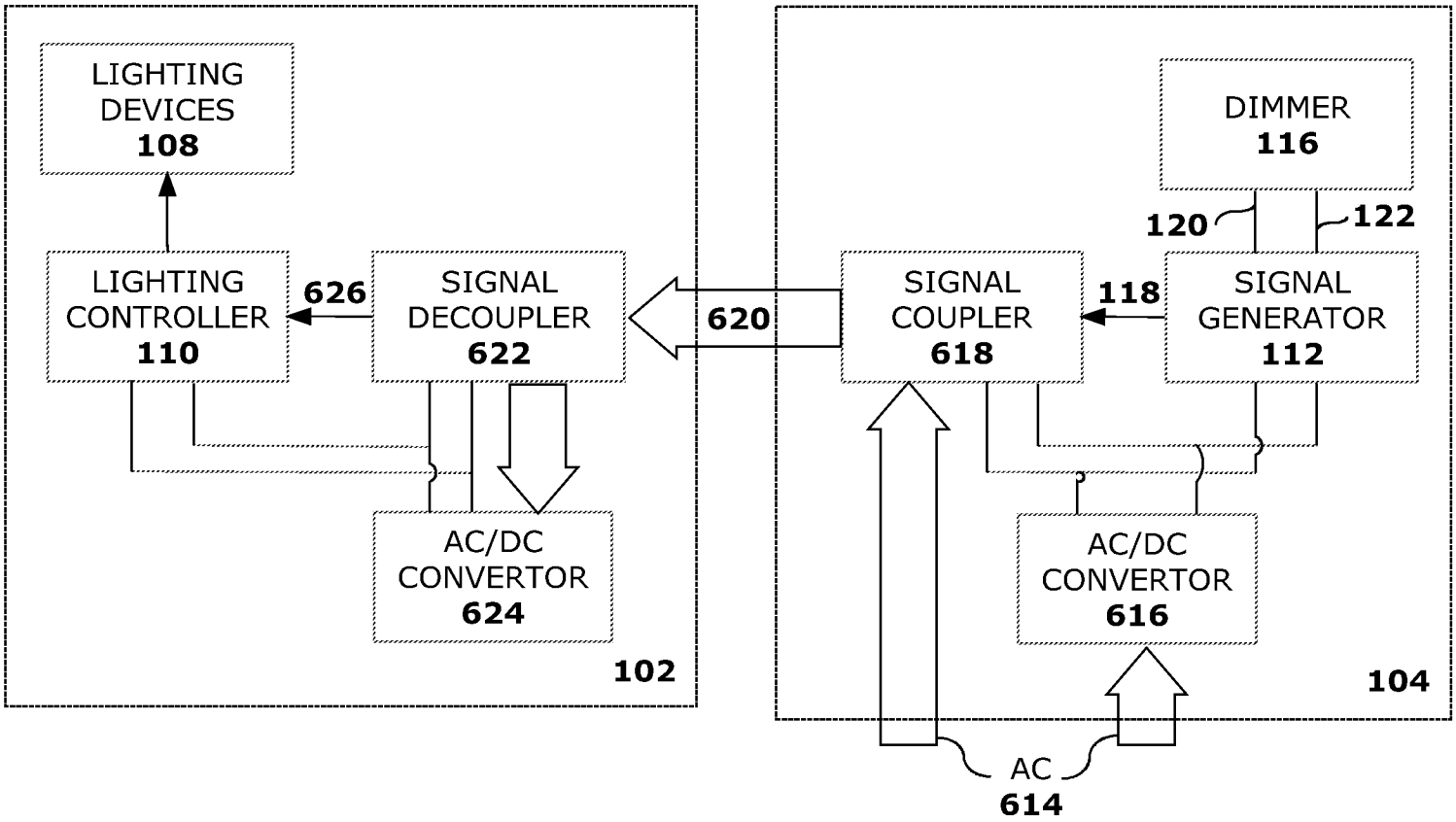

FIG. 6B is a system architecture diagram according to embodiments of the present invention using AC wire coupling technology for communication. The architecture of FIG. 6B is a modified version of the architecture of FIG. 1C and therefore like components are marked with the same references. Within FIG. 6B, the control apparatus 104 has an AC mains input 614 coupled to an AC/DC convertor 616 which supplies DC power to the circuit comprising the signal generator 112 and the dimmer 116. The control apparatus of FIG. 6B further comprises a signal coupler 618 that is powered by the DC output of the AC/DC convertor 616 and receives the output signal 118 from the signal generator 112 as well as the AC supply from the AC input 614. The signal coupler 618 uses power line carrier (PLC) or broadband over power line (BPL) technology to modulate the output signal 118 onto the AC supply such that an AC line 620 coupled between the control apparatus 104 and the lighting apparatus 102 has the AC supply with information associated with the output signal 118 modulated onto the AC sinusoid. In one embodiment, the signal coupler 618 comprises an FSK transmitter that modulates a higher frequency pilot signal using the relatively low frequency output signal 118.

Within FIG. 6B, the lighting apparatus 102 comprises the lighting controller 110 and the lighting devices 108 of FIG. 1C but, instead of the AC/DC convertor 114, the lighting apparatus 102 further comprises a signal decoupler 622 and an AC/DC convertor 624. The signal decoupler 622 is coupled to the AC line 620 and demodulates the signal modulated onto the AC sinusoid. The resulting AC signal is converted by the AC/DC convertor 624 into a DC supply that powers the lighting controller 110, the lighting devices 108 and the signal decoupler 622. The signal decoupler 624 transmits a signal 626 that resulted from the demodulation to the lighting controller 110. The signal 626 may be a regeneration of the output signal 118 or may be a signal that incorporates information related to the frequency of the output signal 118.

In both the implementations of FIGS. 6A and 6B, a signal representative of the output signal 118 or that incorporates information related to the output signal 118 is received by the lighting controller 110. In these cases, the lighting controller 110 can control the lighting devices 108 in a similar manner as described above. In particular, the lighting controller can control an aspect of the light output from the lighting apparatus 102 by controlling the lighting devices 108 in response to the signals received indirectly from the signal generator 112.

Figure 7:
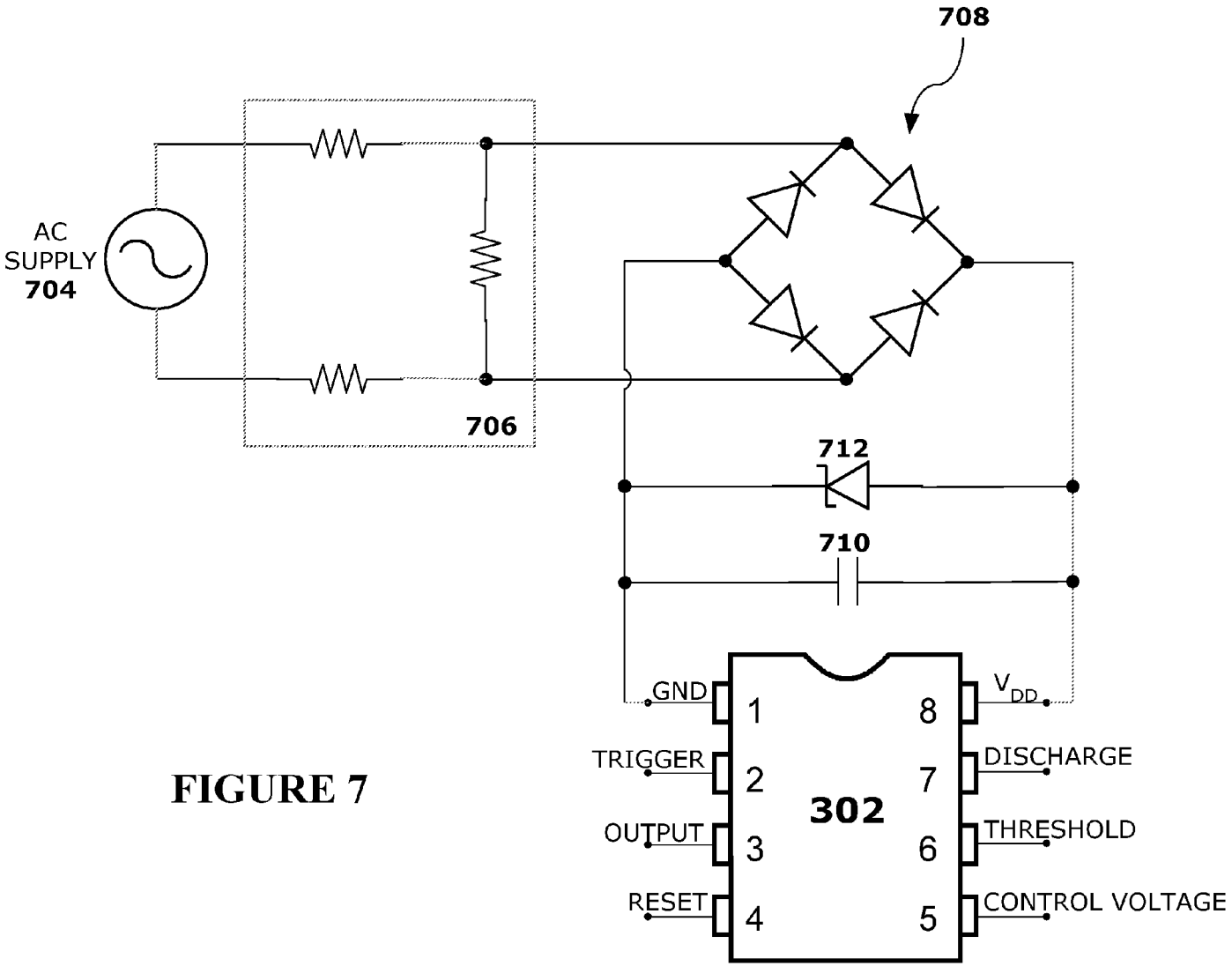
FIG. 7 is a circuit diagram for powering a control apparatus according to one particular example implementation of the present invention.

FIG. 7 is a circuit diagram for powering a control apparatus according to one particular example implementation of the present invention. In specific implementations of the present invention, the component 302 may need to be powered from a DC source but with only an AC source available. This could occur in the embodiments depicted in FIGS. 6A and 6B as well as the embodiment depicted in FIG. 1C if the DC power/ground lines 124 were removed. The circuit of FIG. 7 depicts one particular implementation that could be used to power the component 302 from an AC supply. As shown, the circuit of FIG. 7 comprises the component 302 being powered from an AC supply 704. The AC supply 704 is coupled to a voltage divider 706 which is subsequently coupled to a rectifier 708. The outputs from the rectifier 708 are the voltage supply $V_{DD}$ and the reference ground GND. As shown, a capacitor 710 and a zenor diode 712 are coupled between the outputs of the rectifier. It should be understood that many other well-known techniques for AC/DC conversion can be used for this situation and the implementation of FIG. 7 is only one example of a bridge rectifier.

One example of a calibration procedure that may be used by lighting controller 110 to determine the maximum and minimum periods of the output signal 118 when used with a particular dimmer 116, as noted above, is illustrated in further detail in FIG. 8. The dimmer 116 may have an interface that may have a value that is representative of the state of the interface and may change as the interface of the dimmer 116 is adjusted. For example, in certain embodiments, the value of the interface may be considered to be the impedance of a variable impedance, such as the variable resistor 202 included in the TRIAC dimmer, depicted in FIG. 2, or an alternative dimmer having a variable impedance in series with a capacitor. Such a calibration procedure may be important to provide a full range of adjustment of an aspect of light output desired to be controlled with the dimmer 116, because the maximum and minimum periods of the output signal 118 may vary depending on the properties (e.g. resistance and capacitance) of the particular dimmer 116 coupled to the signal generator 112 (also referred to as the signal generation circuit).

Written instructions may be provided to users to allow users to interpret instructions from the lighting controller 110 and adjust the interface of the dimmer 116 appropriately. When the lighting controller 110 is in a programming mode, the lighting controller 110 may instruct the user to set the interface of the dimmer 116 to a first extreme value at step 150. The lighting controller 110 may enter a programming mode when initialized, or first turned on, or when it is desired to change certain parameters of the lighting controller 110. For example, the lighting controller 110 may cause the lighting devices 108 (light radiating element) to flash or blink a set number of times to instruct the user to set the value of the interface to a first extreme value, for example, the minimum value. The lighting controller may then determine the period of the output signal 118 at step 152 and store the period, for example, the minimum period in memory. As noted above, the period as used herein should be understood to be a duration or other data related to the frequency of a signal, and may include, for example, a half period, for example, the time it takes a signal to transition from high to low and vice versa and multiples of the period. In order to facilitate an accurate measurement of the period at the first extreme value, the minimum period in this example, the lighting controller 110 may wait a certain period of time to ensure a steady state is reached and/or average a number of samples in an attempt to reduce the effects of possible noise. The lighting controller 110 may then instruct the user to set the value of the interface to a second extreme value, for example, the maximum value at step 154. As noted above, instructing the user to set the interface to a second extreme value may be communicated by flashing the lighting devices 108 a predetermined number of times or using another method. The lighting controller 110 may then determine the period of the output signal 118 at the second extreme value, which in this example would be the maximum period of the output signal 118 and store the maximum value in memory at step 156.

After the periods have been determined at the first and second extremes, the user may adjust the interface of the dimmer 116 to a desired value. The lighting controller 110 may determine the period of the output signal 118 associated with the present value of the interface of the dimmer 116 at step 158. The lighting controller 110 may then control an aspect of light output from the lighting devices 108 based on the period relative to the periods at the first and second extreme values of the interface of the dimmer 116 (e.g. the minimum and maximum periods) at step 160. For example, lighting controller 110 may be configured so that the perceived light output (i.e. the output perceived by the human eye) varies approximately linearly as the value of the interface is adjusted from a minimum to a maximum value. Lighting controller 110 may need to convert such an approximately linear relationship to an approximately exponential relationship, for example, to account for lighting devices 108, such as LEDs, that have a non-linear light output (i.e. a non-linear IV curve of a LED). Lighting controller 110 may also continuously monitor and determine the period of the output signal 118 to adjust the light output from the lighting devices 108 responsive to changes to the interface of the dimmer 116 in a similar manner.

Alternatively, the user may cause the lighting controller 110 to enter a programming mode in certain embodiments, for example, by communicating a command via a remote control. The lighting controller 110 may alternatively be operable to enter a programming mode upon initialization. In a programming mode, the user may set the interface of the dimmer to the maximum and minimum extremes within a predetermined amount of time and the maximum and minimum periods of the output signal 118 may be captured and stored by the lighting controller 110. Written instructions may be provided to instruct the user to set the maximum and minimum periods within a predetermined amount of time and to leave the interface of the dimmer at the maximum and minimum extremes for a certain amount of time to ensure an accurate reading. An aspect of the light output from the lighting devices 108 may then be controlled based on the value of the output signal 118 relative to the maximum and minimum periods of the output signal 118 as described above.

Figure 9:
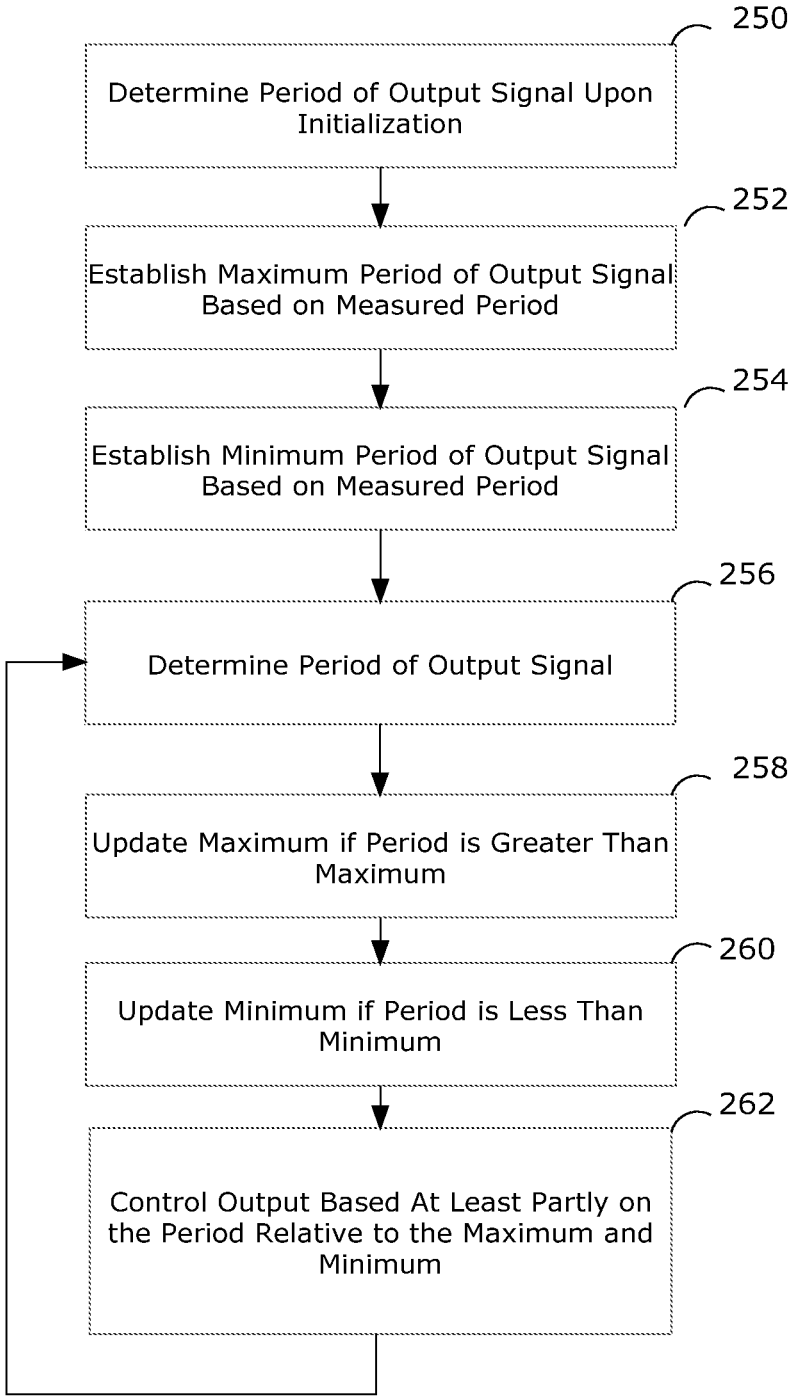
FIG. 9 is a flowchart illustrating certain steps for another method of calibrating a lighting controller for use with a particular dimmer.

FIG. 9 illustrates an alternative calibration procedure that may allow lighting controller 110 to control the light output from lighting devices 108 when used with a particular dimmer 116 having a particular range of impedance values that may be adjusted by changing the value of an interface. The dimmer 116 may have an interface that may have a value representative of the state of the interface of the dimmer, for example, the impedance of a variable impedance that may be adjusted by the interface as described above. In contrast to the calibration procedure described with respect to FIG. 8, the calibration procedure illustrated in FIG. 9 does not require the user to undertake a series of steps in a programming mode, or upon initialization, of the lighting controller 110 and may be referred to as an adaptive or automatic calibration procedure.

When the lighting controller 110 is in a programming mode, for example, when initialized or turned on, the interface of the dimmer 116 may have an initial value. It should be understood that when sampling periods, the samples may be filtered for noise by, for example, eliminating the 2 greatest outliers among 8 running samples leading to the present sample and using the average of the 6 non-outliers as the "sample". Additionally, when sampling for the minimum and maximum, additional care can be taken to ensure that at least 256 (or some other large number) of samples occurred within 1 or 2 units of the maximum or minimum being updated, since the normal use of a dimmer is to leave it alone once the user has adjusted it to the appropriate level. The lighting controller 110 may determine the initial period of the output signal 118 after a delay to ensure that a steady state has been reached and store the value of the period in memory at step 250. The lighting controller 110 may then establish a maximum period of the output signal 118 at step 252. The maximum period should be chosen to be in close proximity to the initial period upon initialization. For example, the maximum period could be set to be the initial period, or another period in close proximity to the initial period, such as the initial period plus 1. Alternative methods to establish an initial value of the maximum period may also be used in certain implementations. Similarly, the lighting controller 110 may establish an initial value for a minimum period of the output signal 118 and store the minimum period in memory at step 254. The initial value of the minimum period may also be chosen to be in close proximity to the initial period, for example, the initial value of the minimum period could be chosen to be the initial period minus 1. Other initial values for the minimum period may also be chosen without departing from the scope of the invention. Steps 250, 252, and 254 may be considered to be part of the initialization procedure of the lighting controller 110 and may only be performed when the lighting controller 110 is first turned on or in a programming mode.

During continued or ongoing operation, the lighting controller 110 may determine the period of the output signal 118 at step 256 and be operable to detect changes in the period of the output signal 118 as the value of the interface of the dimmer is changed. If the period of the output signal 118 is greater than the maximum value of the period stored in memory the maximum value may be set to be the period of the output signal 118 and the updated maximum value may be stored in memory at step 258. Analogously, if the period of the output signal 118 is less than the minimum value of the period stored in memory the minimum value may be set to be the period of the output signal 118 and the updated minimum value may be stored in memory at step 260. The lighting controller 110 may then control an aspect of the light output from lighting devices 108 based on the period of the output signal (value of the interface of the dimmer) relative to the maximum and minimum values of the period at step 262. For example, an aspect of the light output may be controlled based on the percentage that the period is between the minimum and maximum values. The minimum and maximum values of the period may also be considered to be a first and second extreme value of the interface as used hereinafter. To achieve a percentage value of an aspect of the light output to be controlled the following representative formula may be used:

$$\%\ \text{Aspect} = \frac{(\text{Period} - MinimumPeriod)}{(MaximumPeriod - MinimumPeriod)}$$

Alternatively, other methods to control an aspect of the light output, such as the luminosity may also be used without departing from the scope of the invention. The lighting controller 110 may then proceed to determine the period of the output signal 118 to determine if the period has changed responsive to a change in the value of the interface at step 256 and repeat the steps 256, 258, 260, and 262 in a loop during continued operation.

Other embodiments of the invention may not utilize a calibration procedure or adaptive algorithm to account for the variation between various types of dimmers, including different implementations of TRIAC dimmers that may have a different range of resistance or impedance values. Instead, these embodiments may be designed to be suitable for use with a particular model of a dimmer having known properties. For example, one embodiment of the invention may be designed to be used with a particular TRIAC dimmer having known properties so that the minimum and maximum periods, or more generally the value of the interface, at the first and second extreme values of the interface of the dimmer are known and the lighting controller 110 may control an aspect of the light output based on the period of the output signal 118 relative to the known minimum and maximum periods.

These embodiments may be suitable for use with a low cost lighting controller 110 that may have limited functionality, for example, the Lutron Skylark model number S-600H-WH-CSA. For example, certain lighting controllers 110 may have limited memory resources such that a minimum and maximum value of the interface of the dimmer 116 or period of the output signal 118 of the signal generation circuit 112 cannot be stored dynamically, but rather must be programmed into ROM as part of the manufacture of the lighting controller 110. In one embodiment, the minimum and maximum periods of the output signal 118 for a particular dimmer 116 may be programmed during the manufacture of the lighting controller 110 so that the period of the output signal 118 may be properly interpreted by the lighting controller 110, when used with the particular dimmer 116, to control an aspect of the light output from the lighting devices 118 based at least in part on the period of the output signal, or the value of the interface of the dimmer 116, relative to the maximum and minimum values of the period of the output signal 118 or the maximum and minimum values of the interface.

In another embodiment of the invention illustrated in FIG. 10, a lighting controller 110 may be matched to a particular dimmer even though the lighting controller 110 has a predetermined maximum and minimum period that was not specifically calibrated for use with the particular dimmer. The signal generation circuit 112 (signal generator) and dimmer 116 may have the same functionality as described with reference to FIG. 3. This embodiment may also include an impedance matching circuit 315 so that the period of the output signal 118 when the signal generation circuit 112 is coupled to the dimmer 116 has a minimum and maximum period that is in close proximity to the predetermined minimum and maximum values that are programmed into the lighting controller 110. In this manner, the lighting controller 110 may control an aspect of the light output, such as the luminosity (intensity) of the lighting devices 108, based on the period of the output signal 118 relative to the maximum and minimum periods.

The impedance matching circuit 315 may be comprised of a variable resistor 307 connected in series with node N1 of the dimmer 116 and a variable resistor 313 connected in parallel between node N1 of the dimmer 116 and node N2. Although adjustments to the impedance of both variable resistors 307 and 313 affect the period of the output signal 118, adjusting variable resistor 307 may be considered to primarily change the absolute value of the period of the output signal 118. Conversely, adjustments to variable resistor 313 may be considered to primarily change the difference between the maximum and minimum values of the period of the output signal 118. Alternatively, certain embodiments of the impedance matching circuit 315 may only include variable resistor 307 and not variable resistor 313, but may lack the range of adjustment when compared to an impedance matching circuit 315 having multiple variable resistors as described above. In a further alternative, impedance matching circuit 315 may be implemented using transresistance or transimpedance amplifiers instead of variable resistors and may generally be considered to be comprised of elements having variable impedances that may be adjusted as required in the particular implementation.

Figure 11:
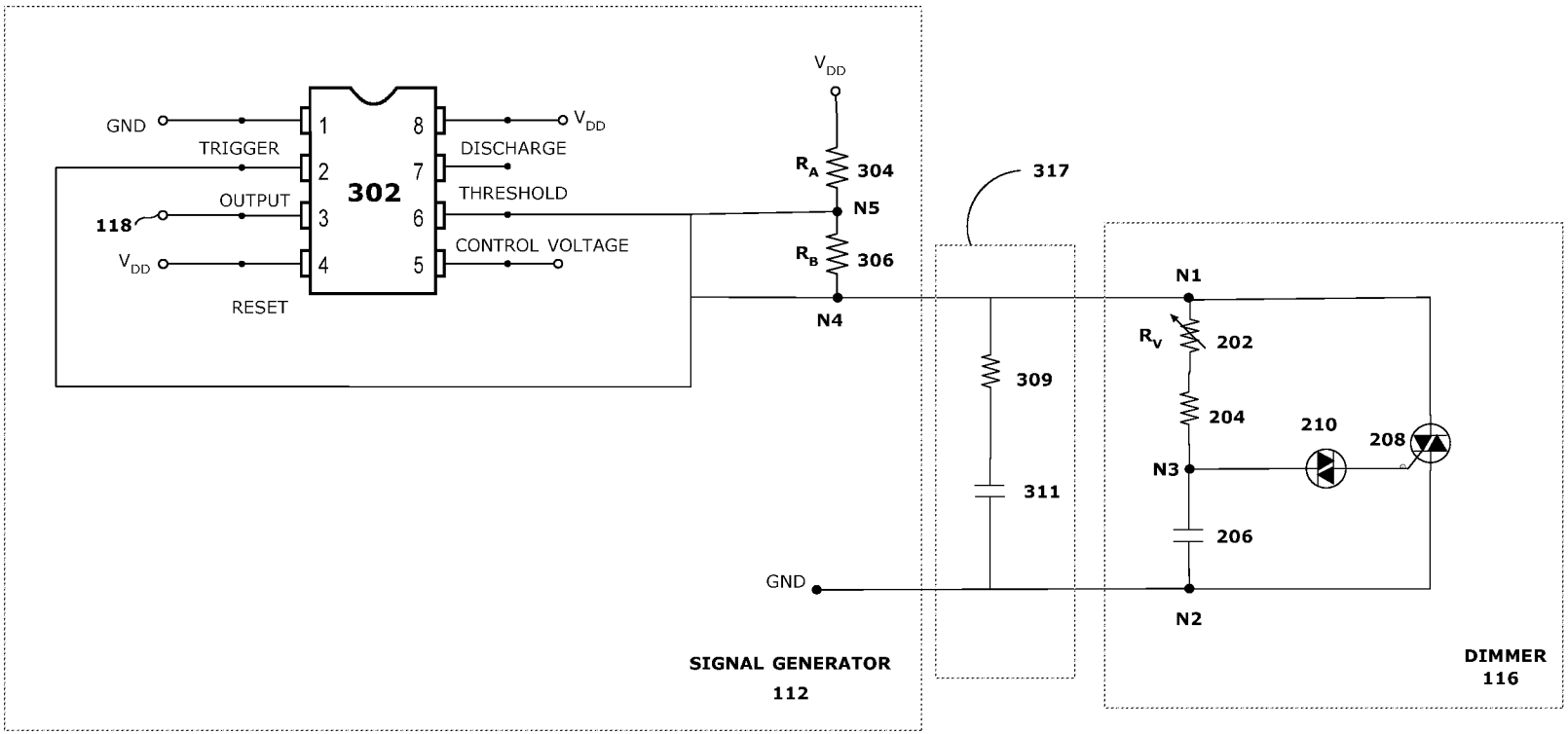
FIG. 11 is a circuit diagram of a signal generator and TRIAC dimmer according to a first embodiment of the present invention having a frequency compensation circuit.

Certain embodiments of lighting apparatus 102 may also include a frequency compensation circuit 317 that may be coupled between the signal generation circuit 112 and dimmer 116 as shown in FIG. 11. The signal generator 112 and dimmer 116 may have the same functionality as previously described with reference to FIG. 3. The frequency compensation circuit 317 may comprise a resistor 309 in series with a capacitor 311 coupled between nodes N1 and N2 of dimmer 116. The resistor 309 may be chosen to be a large resistance, for example, 1 MΩ, and the capacitor 311 may be chosen to be, for example, 1 mF, for use with many TRIAC dimmers. Other values of the resistor 309 and capacitor 311 may be required for use with certain implementations of dimmer 116. The frequency compensation circuit 317 may act to prevent a runaway frequency of the output signal 118 when the signal generation circuit 112 is disconnected from the dimmer 116 to increase the stability of the lighting apparatus 102.

Figure 12:
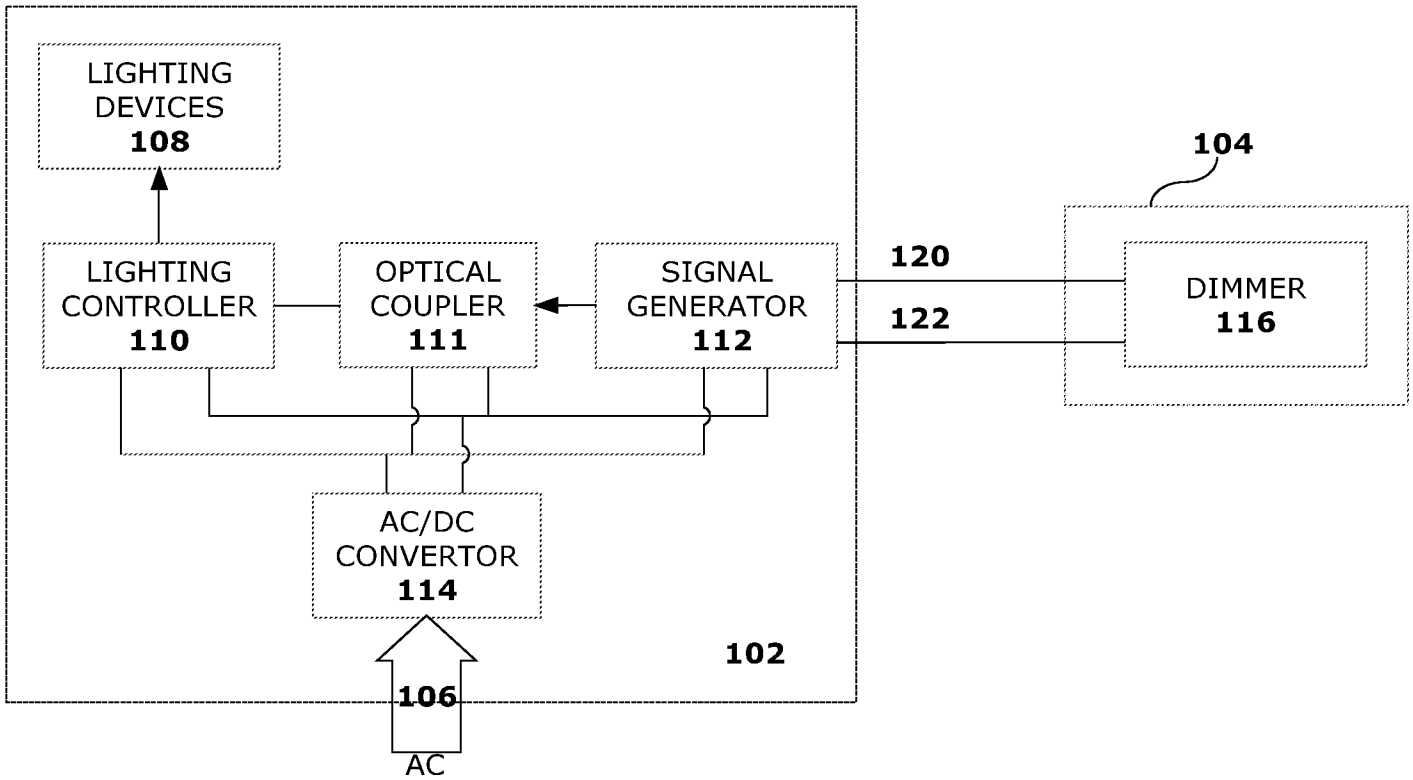
FIG. 12 is a system architecture diagram of an embodiment of the invention having an optical coupler.

FIG. 12 depicts another embodiment of lighting apparatus 102 that is similar in functionality to that previously described in FIG. 1B, so like components may be assumed to have like functionality. In addition to the components previously described, the embodiment in FIG. 12 may include an optical coupler 111 that may be coupled between the lighting controller 110 and signal generator 112 and powered by the AC/DC converter 114. The optical coupler 111 may be comprised of a photodiode and infrared emitter, as is known in the art, and provide isolation between the signal generator 112 and lighting controller 110. Additionally, the signal generator may be isolated electrically from the AC/DC converter by means of a second transformer winding, or even an LED based optical power coupling system using a small solar panel and LED since the current required is minimal. Providing isolation between the signal generator 112 and lighting controller 110 may improve performance in certain embodiments where common mode currents are present and may impact the reliability of the lighting apparatus 102.

Figure 13A:
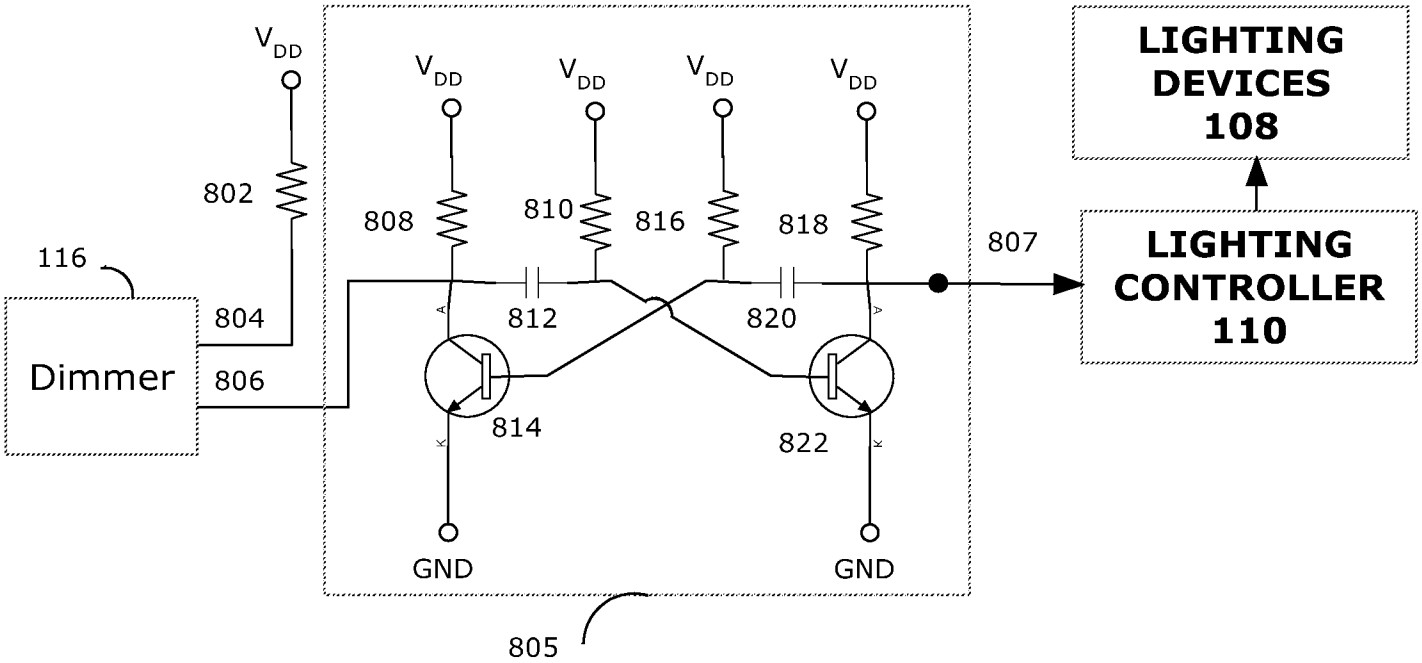
FIG. 13A is a system architecture diagram of an embodiment of the invention employing an alternative embodiment of a signal generation circuit.

Another embodiment of the lighting apparatus 102 is depicted in part in FIG. 13A. Generally, this embodiment may be considered to use an astable multivibrator to implement a signal generation circuit 805 in place of the circuit described previously with reference to FIG. 3. This embodiment may have a dimmer 116 coupled to a signal generation circuit 805 that may be implemented as an astable multivibrator, which is well known in the art, operable to generate an output signal 807. The output signal 807 may have a period that is dictated at least in part by the value of the interface of the dimmer 116. The output signal 807 may be received by a lighting controller 110 that may control an aspect of the light output from the lighting devices 108 as previously described.

The astable multivibrator used to implement one embodiment of signal generation circuit 805 may comprise transistors 814 and 822 that may be npn bipolar junction transistors (BJT). The astable multivibrator may also include resistors 808, 810, 816, and 818 and capacitors 812 and 820 that may be connected as illustrated in FIG. 13A and may have the following component values, in one particular implementation:

| Component | Value |
|---|---|
| Resistor 808 | 500 kΩ |
| Resistor 810 | 1 MΩ |
| Capacitor 812 | 10 nF |
| Resistor 816 | 1 MΩ |
| Resistor 818 | 500 kΩ |
| Capacitor 820 | 10 Nf |

Figure 13B:
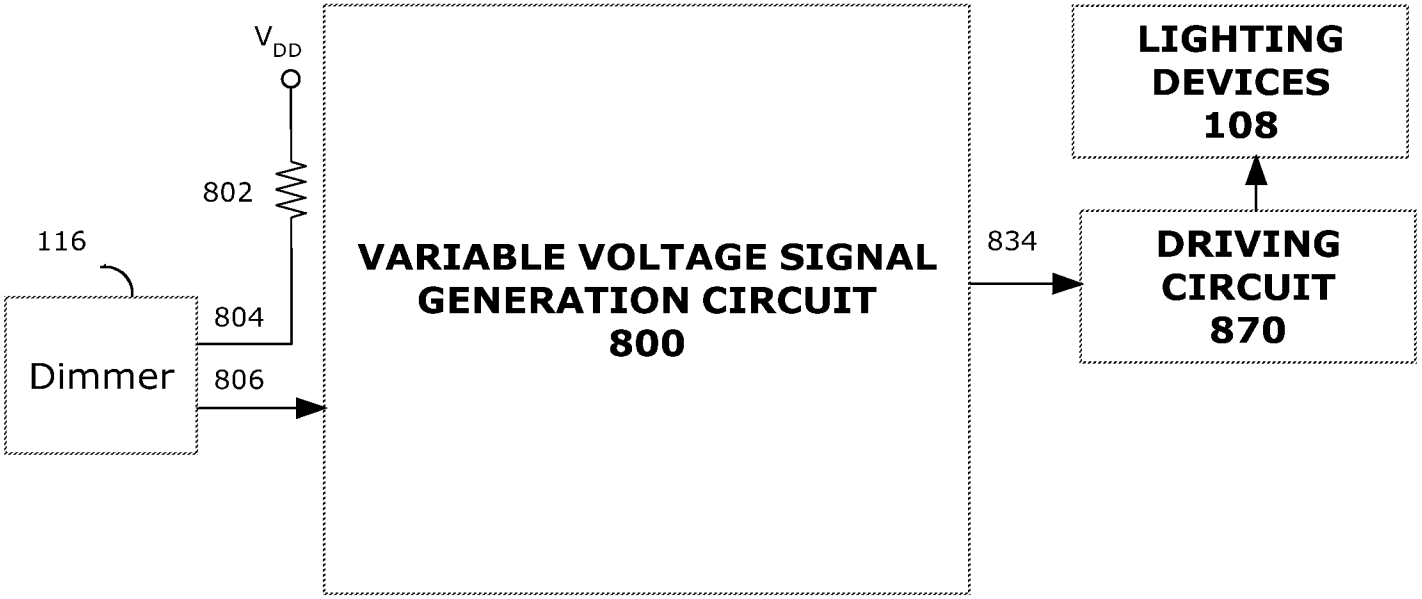
FIG. 13B is a system architecture diagram of an embodiment of the invention having a variable voltage signal generation circuit.
Figure 13C:
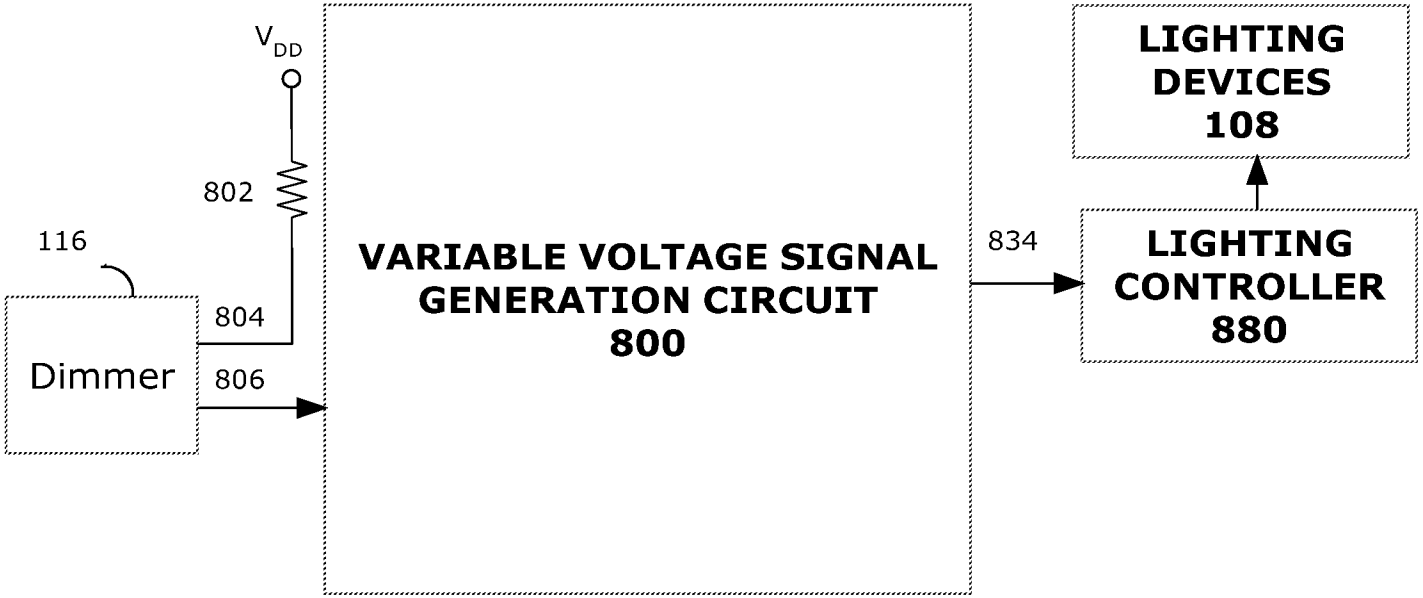
FIG. 13C is a system architecture diagram of an embodiment of the invention having a variable voltage signal generation circuit and a lighting controller.
Figure 13D:
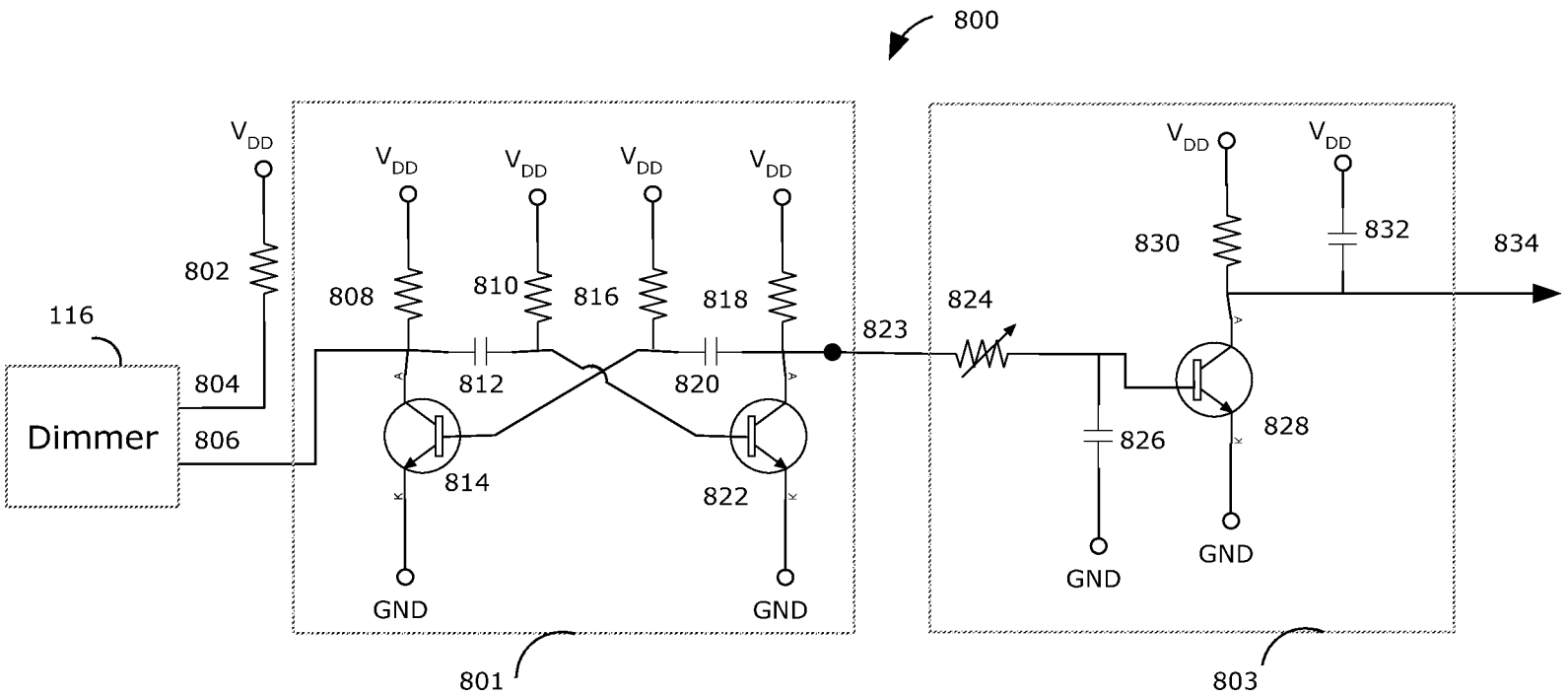
FIG. 13D is an embodiment of a variable voltage signal generation circuit that may be used in certain embodiments of the invention.

The lighting apparatus 102 may also be constructed using a variable voltage signal generation circuit 800 that is illustrated in FIGS. 13B-13D. For example, as shown in FIG. 13B, a variable voltage signal generation circuit 800 may be coupled to a dimmer 116, which may be a TRIAC dimmer, and may have an output signal 834 that may have a voltage that is dictated at least in part by the value of the interface of the dimmer 116 and may vary as the value of the interface is adjusted. The output signal 834 may be received by a driving circuit 870 that is operable to control an aspect of the light output from lighting devices 108 based on the voltage of the output signal 834. More specifically, the driving circuit 870 may operate to supply a PWM signal to the lighting devices 108 having a duty cycle that is dictated at least in part by the voltage of the output signal 834. The driving circuit 870 may be implemented as a lighting controller 880 as shown in FIG. 13C, a monostable multivibrator 850 as described below in greater detail with reference to FIG. 14, or as a circuit using a 555 timer operating in a monostable vibratory oscillation mode as described below in greater detail with reference to FIG. 15B. In embodiments where the driving circuit 870 is implemented as a lighting controller 880, a constant current signal could be supplied to the lighting devices 108, with the current being dictated at least in part by the voltage of the output signal 834. The fact that the variable voltage signal generation circuit 800 is operable to provide a variable voltage output may be advantageous as it may allow the variable voltage signal generation circuit 800 to be used with existing lighting controllers that have been designed for use with 0-10V dimmers currently on the market allowing TRIAC dimmers to be used in place of 0-10V dimmers. This may allow existing lighting systems to be more readily modified for use with the variable voltage signal generation circuit 800 and more generally for use with a TRIAC dimmer.

One particular embodiment of a variable voltage signal generation circuit 800 is illustrated in FIG. 13D. The dimmer 116 may have an interface as previously described and may be a TRIAC dimmer, although other types of dimmers may be used in certain embodiments. The dimmer 116 may be coupled to a resistor 802 that is coupled to a DC power supply $V_{DD}$ at a power supply node 804. The output node 806 of the dimmer 116 may be coupled to a signal generation circuit 801. The signal generation circuit 801 may be operable to generate a periodic signal 823 having a period that may be dictated at least in part by the value of the interface of the dimmer 116. A voltage conversion circuit, such as the filter 803, may be coupled to the signal generation circuit 801 to receive the periodic signal 823 and generate an output signal 834. The output signal 834 generated by the voltage conversion circuit, for example, the filter 803 may have a voltage that is dictated at least in part by the period of the periodic signal 823 so that the voltage of the output signal 834 is dictated at least in part by the value of the interface of the dimmer 116. The filter 803 may be, for example, a low pass filter although other types of filters may be used.

Alternatively, the voltage conversion circuit may be implemented in another configuration that may generate an output signal having a voltage that is dependent on the frequency of the input signal without departing from the scope of the invention. For example, the voltage conversion circuit may be implemented as a microcontroller operable to receive the periodic signal 823 and generate an output signal 834 having a voltage that is dictated at least in part by the value of the interface of the dimmer 116. Additionally, the signal generation circuit 801 shown in FIG. 13D may be implemented using a 555 timer in an astable vibratory oscillation mode, similar to that described with reference to FIG. 3, in place of an astable multivibrator and may be used with either a microcontroller or filter 803 with suitable modification to generate an output signal 834 having a voltage that is dependent on the value of the interface of the dimmer 116.

The signal generation circuit 801 may be implemented as an astable multivibrator, similar to that described above with reference to FIG. 13A.

An embodiment of the filter 803 may have a variable resistor 824 coupled in series to the output of the signal generation circuit 801. The value of the variable resistor 824 may vary depending on the particular dimmer 116 that may be coupled to the variable voltage signal generation circuit 800 and may be, for example, 100 kΩ. The variable resistor 824 may be coupled to the base of an npn BJT 828 and a capacitor 826 that may be coupled in parallel with the BJT 828 and coupled to ground at one terminal. The emitter of the BJT 828 may be coupled to ground and the collector may be coupled to a resistor 830 and capacitor 832 connected in parallel to a DC supply voltage $V_{DD}$. The output signal 834 may also be taken from the node common to the collector of BJT 828 and the resistor 830 and capacitor 832. The component values in one particular implementation may be as follows: capacitor 826—0.67 nF; resistor 830—100 kΩ; and capacitor 832—1 nF.

Figure 14:
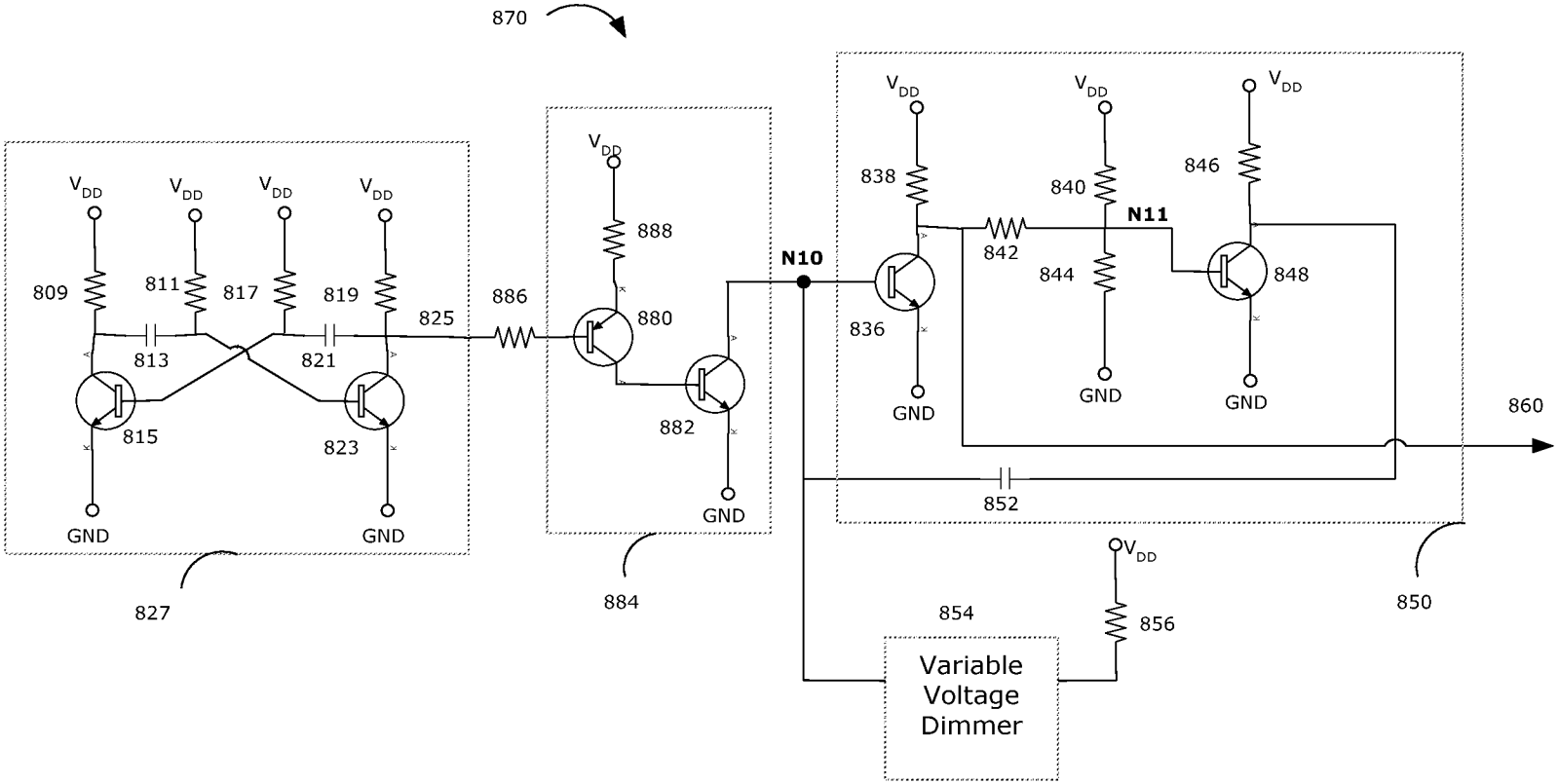
FIG. 14 is a circuit diagram of an embodiment of a driving circuit.

One implementation of a driving circuit 870, that does not employ a microcontroller, which may reduce costs, is illustrated in FIG. 14. As noted above, the driving circuit 870 may operate to generate a PWM signal to be supplied to the lighting devices 108 having a duty cycle that may be adjusted to control an aspect of the light output from the lighting devices.

For example, the duty cycle of the PWM signal may be dictated at least in part by the voltage of the output signal 834 received from a variable voltage signal generation circuit 800. In one embodiment, the driving circuit 870 may include an astable multivibrator 827 as configured in FIG. 14 that is operable to generate a periodic signal 825. The component values used in the astable multivibrator 827 may vary depending on the particular application, however, the component values of a sample implementation may be as follows:

| Component | Value |
|---|---|
| Resistor 809 | 10 kΩ |
| Resistor 811 | 1 MΩ |
| Capacitor 813 | 3 nF |
| Resistor 817 | 1 MΩ |
| Resistor 819 | 10 kΩ |
| Capacitor 821 | 100 pF |

Alternatively, a circuit employing a 555 timer operating in an astable vibratory oscillation mode may be used in place of the astable multivibrator 827 in certain embodiments as will be described with reference to FIG. 15B.

A resistor 886 may be coupled in series between the output of the astable multivibrator 827 and an amplifier 884 with the amplifier 884 coupled to receive the periodic signal 825. The amplifier 884 may comprise a pnp BJT 880, with the base of BJT 880 being coupled to the resistor 886. The emitter of the BJT 880 may be coupled to a resistor 888, with the resistor 888 also being coupled to a DC power supply $V_{DD}$. The collector of BJT 880 may be coupled to the base of a npn BJT 882. The emitter of BJT 882 may be coupled to ground and the collector may be coupled to a node N10. The amplifier 884 may be operable to provide isolation to the astable multivibrator 827 and generate an amplified version of the periodic signal 825.

The input to a monostable multivibrator 850 may also be coupled to node N10 to receive the amplified version of the periodic signal 825. The monostable multivibrator 850 may have a npn BJT 836 having its base coupled to node N10. The emitter of BJT 836 may be coupled to ground and the collector may be coupled to a resistor 838 that may be coupled to the DC power supply $V_{DD}$. A resistor 842 may also be coupled between the collector of BJT 836 and a node N11. A resistor 840 may also be coupled between the DC power supply $V_{DD}$ and node N11. A resistor 844 may be coupled between node N11 and ground. The base of a npn BJT 848 may be coupled to node N11. The emitter of BJT 848 may be coupled to ground and a resistor 846 may be coupled between the collector of BJT 848 and the DC power supply $V_{DD}$. The collector of BJT 848 may also be coupled to a capacitor 852, with the capacitor 852 also being coupled to node N10. A driving signal 860 may be generated by the monostable multivibrator 850 and output via a line coupled to the collector of BJT 836. The driving signal 860 may be coupled to the lighting devices 108 to provide a current to provide a light output from the lighting devices 108.

Alternatively, a circuit employing a 555 timer operating in a monostable vibratory oscillation mode may be operable to receive the amplified version of the periodic signal 825 and generate a driving signal 860 in a similar fashion to the monostable multivibrator 850 described above.

A variable voltage dimmer 854 may also be coupled to the driving circuit 870 at node N10. The variable voltage dimmer 854 may also be coupled to a resistor 856 that may be coupled to a DC power supply $V_{DD}$. The variable voltage dimmer 854 may provide a control signal (not shown) to node N10 having a voltage that is representative of the value of the interface of the variable voltage dimmer 854 and varies depending on the value of said interface. The output signal 860 may vary depending on the voltage of the control signal provided to node N10 by the variable voltage dimmer 854 so that the driving signal 860 is dictated at least in part by the value of the interface of the variable voltage dimmer 854. More specifically, the driving signal 860 may be a pulse width modulated (PWM) signal having a duty cycle that is dependent on the voltage of the control signal so that an aspect of the light output from the lighting devices, for example, the luminosity, may be controlled by the duty cycle of the driving signal 860.

The variable voltage dimmer 854 may be implemented as a variable voltage signal generation circuit 800, as described with reference to FIGS. 13B-13D, that may be configured to have the output signal 834 coupled to node N10 so that the duty cycle of the driving signal 860, which may be a PWM signal, is dictated at least in part by the voltage of the output signal 834. This particular configuration may be a low cost implementation that facilitates that use of a TRIAC dimmer. Alternatively, a commercially available 0-10V dimmer, which may be implemented as a potentiometer and diode in series, may be used to implement a variable voltage dimmer 854 in certain embodiments. Of course, other analogous circuits could be used to provide a similar functionality without departing from the scope of the invention and the circuit described above is merely a representative example of a possible implementation. For example, other possible implementations of a variable voltage signal generation circuit, driving circuit, etc. may be used without departing from the scope of the invention.

Figure 15A:
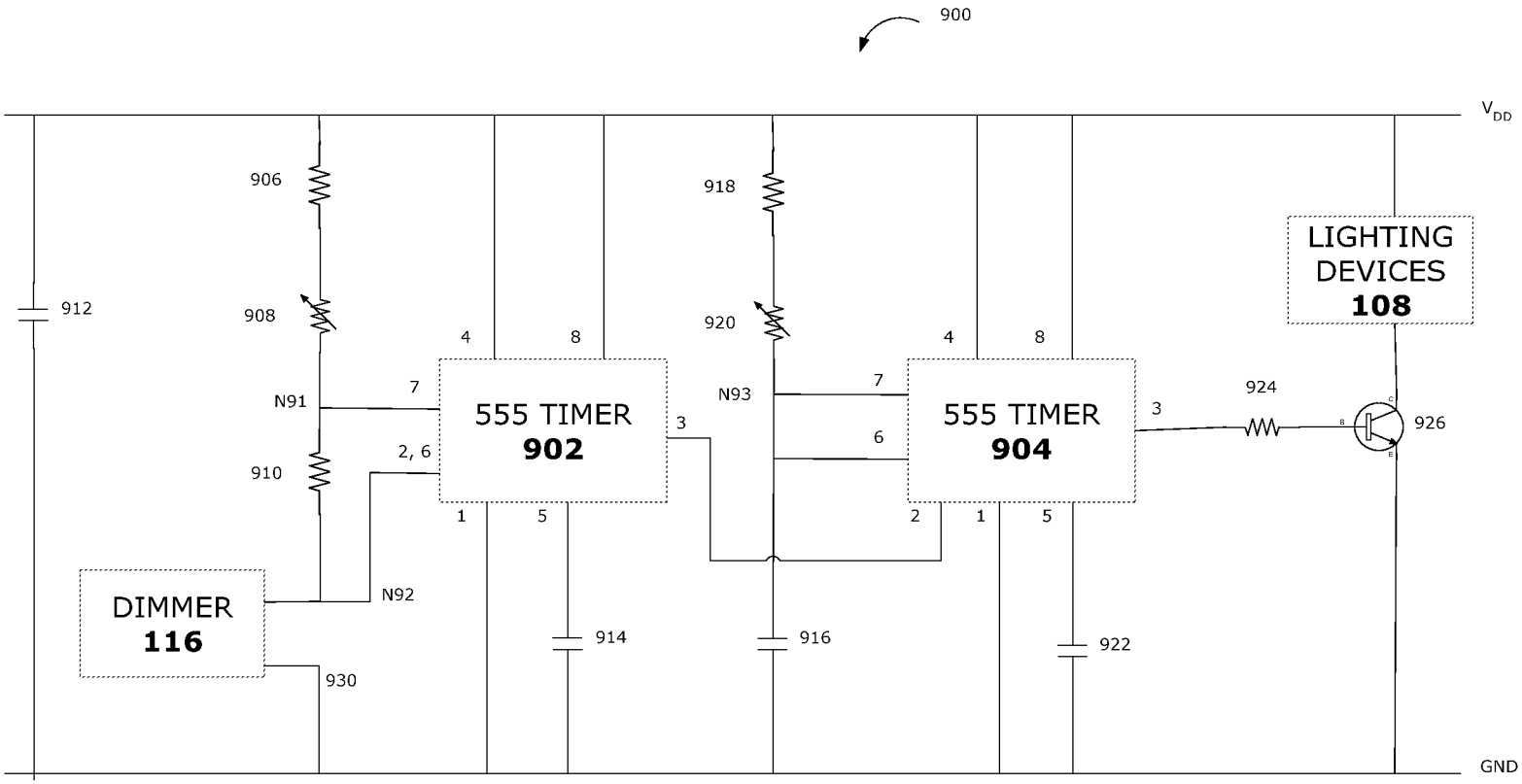
FIG. 15A is a circuit diagram of yet another embodiment of the invention having two 555 timers.

Other possible embodiments of a lighting apparatus that do not employ a lighting controller 110 may also be used with a dimmer 116, which may be a TRIAC dimmer, without departing from the scope of the invention. For example, lighting apparatus 900 illustrated in FIG. 15A may be implemented using two 555 timers or circuits having similar functionality. The 555 timers 902 and 904 may have the same terminal numbering and functionality as described previously with respect to component 302, illustrated in FIG. 3. Similarly, components with element numbers previously used may have similar functionality to that previously described, including the dimmer 116 and the lighting devices 108.

Lighting apparatus 900 may have a capacitor 912 coupled between a DC power supply $V_{DD}$ and ground. In parallel with the capacitor 912, a resistor 906 may be connected in series with a variable resistor 902 between the DC power supply $V_{DD}$ and node N91. A resistor 910 may be coupled between node N91 and node N92.

A dimmer 116 may have a connection node coupled to node N92 and a line 930 coupled to ground. A 555 timer 902 may have terminal 7 (discharge) coupled to node N91. Terminals 4 (reset) and 8 of the 555 timer 902 may be coupled to the DC power supply $V_{DD}$. Terminals 2 (trigger) and 6 (threshold) of the 555 timer 902 may be coupled to node N92 so that an indication of the value of the interface of the dimmer 116 may be provided to the 555 timer 902. Terminal 1 of the 555 timer 902 may be coupled to ground and terminal 5 (control voltage) may be coupled to a capacitor 914, which is in turn coupled to ground. The output terminal, terminal 3, of the 555 timer 902 may be coupled to terminal 2 (trigger) of a second 555 timer, 555 timer 904.

Resistor 918 may be coupled in series with a variable resistor 920 between the DC power supply $V_{DD}$ and node N93. A capacitor 916 may be coupled between node N93 and ground. Terminals 6 (threshold) and 7 (discharge) of the 555 timer 904 may also be coupled to node N93. Terminals 4 (reset) and 8 of the 555 timer 904 may be coupled to the DC power supply $V_{DD}$. Terminal 1 of the 555 timer 904 may be coupled to ground and terminal 5 (control voltage) may be coupled to a capacitor 922, which is in turn coupled to ground. The output terminal, terminal 3, of the 555 timer 904 may be coupled to a resistor 924, the resistor 924 may also be coupled to the base of a transistor 926, which may be a npn BJT. The emitter of the transistor 926 may be coupled to ground and the collector of the transistor may be coupled to the lighting devices 108, which may also be coupled to the DC power supply $V_{DD}$. In this configuration, the output signal provided from 555 timer 904 may be used to modulate the current that may flow from the DC power supply $V_{DD}$ through the lighting devices 108 by modulating the current that flows through transistor 926. More specifically, a PWM signal may be supplied to the lighting devices 108 having a duty cycle that is dictated at least in part by the value of the dimmer 116 so that an aspect of the light output from the lighting devices 108 may be controlled by adjusting the duty cycle of the PWM signal responsive to changes to the interface of the dimmer 116. Alternatively, other configurations including different types of transistors may be used without departing from the scope of the invention according to well known principles. Generally, the component values for elements shown in FIG. 15A should be chosen so that the 555 timer 902 operates in an astable vibrator oscillation mode and the 555 timer 904 operates in a monostable vibrator oscillation mode. More specifically, the component values for elements shown in FIG. 15A should be chosen to allow the frequency of the 555 timer 902, which may act similarly to an astable multivibrator, to change between two values based on the TRIAC dimmer such that the first value is a maximum period and the second value is a minimum period. Similarly, components should be chosen to ensure that the decay time of the 555 timer 904, which may act similar to a monostable multivibrator, is equal to the minimum period, so that the output during the minimum period is always on, and the inverted output is an LED that is always off. The maximum pulse width on for the lighting devices will occur during the maximum period of the astable multivibrator, which may be a duty cycle of approximately 50%.

Additionally, other circuit elements may be used in place of the 555 timers noted above to provide a similar functionality without departing from the scope of the invention. For example, an astable multivibrator may be used in place of the 555 timer 902 and accompanying components in certain embodiments to generate a periodic signal having a period that is based at least in part on the value of the interface of the dimmer 116. Similarly, a monostable multivibrator could be used in place of the 555 timer 904 and accompanying circuit in certain embodiments. A microcontroller may also be used in place of the 555 timer 904 in some embodiments. The alternatives noted above may also be combined in different ways and the alternatives noted should be considered functional substitutes that may be interchanged with suitable modification as known to persons skilled in the art.

Figure 15B:
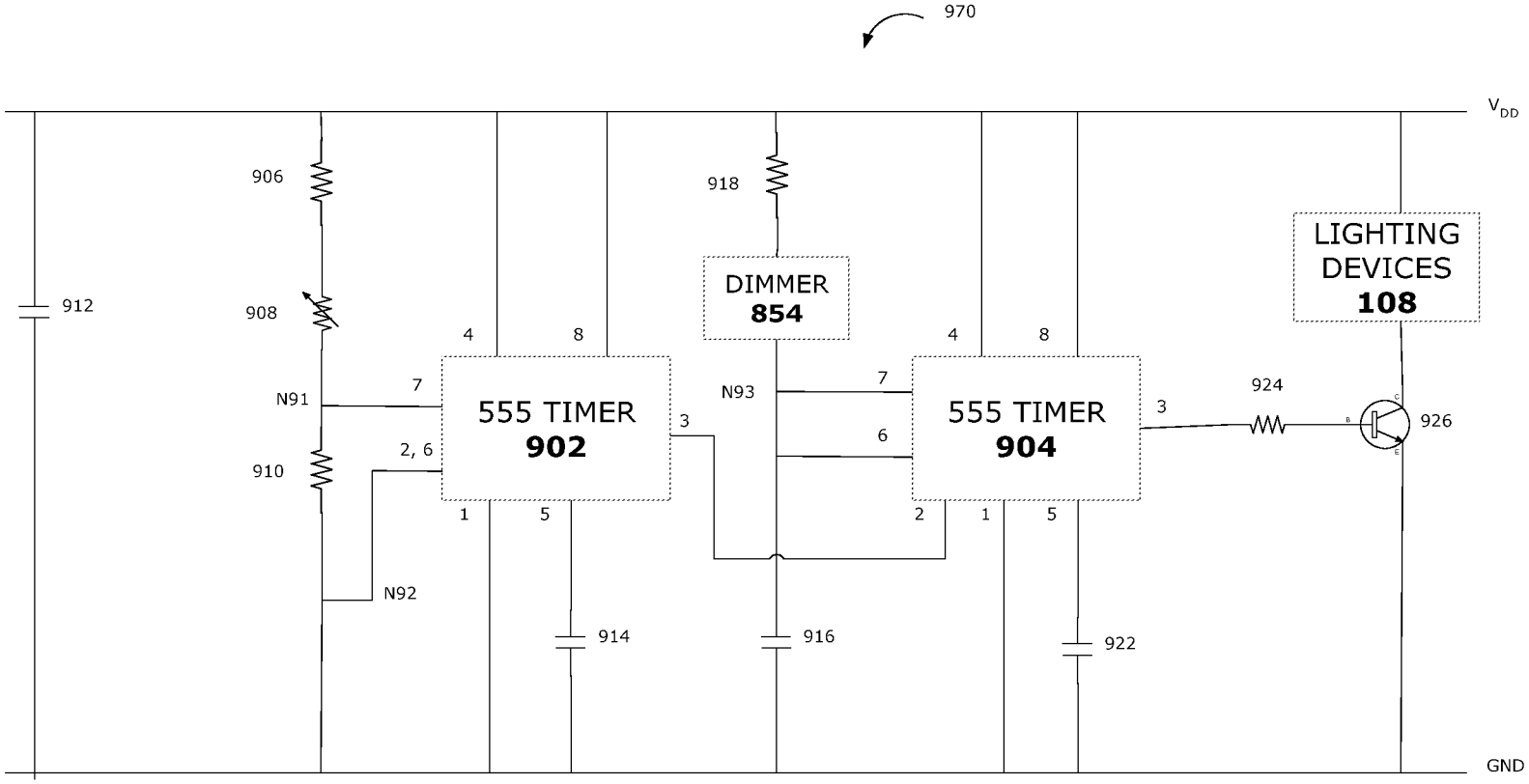
FIG. 15B is a circuit diagram of a further embodiment of the invention having two 555 timers and a variable voltage dimmer.

Another embodiment of a lighting apparatus 970 that may be used with a variable voltage dimmer 854 is illustrated in FIG. 15B with like components having like functionality to that described above with reference to FIG. 15A. The variable voltage dimmer 854 may be implemented as a variable voltage signal generation circuit 800 coupled to a dimmer 116, that may be a TRIAC dimmer, as described above with reference to FIGS. 13B-13D. Alternatively, the variable voltage dimmer 854 may be implemented as a commercially available 0-10V dimmer in other embodiments. The circuit disclosed in FIG. 15B may function as a driving circuit operable to generate a PWM signal that may be supplied to the lighting devices 108 having a duty cycle that is dictated at least partially by the voltage output from the variable voltage dimmer 854. In this manner, the voltage output from the variable voltage dimmer 854, for example, the output signal 834 when the variable voltage dimmer 854 is implemented using the variable voltage signal generation circuit 800 shown in FIG. 13D, may be used to control an aspect of the light output (e.g. the intensity) from the lighting apparatus 970.

Within FIG. 15B, the 555 timers may be connected in a similar manner to that described above with reference to FIG. 15A except the dimmer 116 is not present and terminals 2 and 6 of the 555 timer 902 and resistor 910 are coupled to ground instead of to the dimmer 116. A resistor 918 may be coupled in series with a variable voltage dimmer 854 coupled between the DC power supply $V_{DD}$ and a node N93. The 555 timer 904 may be configured and otherwise operate as described above with reference to FIG. 15A but generate an output signal that is dictated at least in part by the voltage provided to node N93 by the variable voltage dimmer 854 so that an aspect of the light output from the lighting devices 108 may be controlled by the variable voltage dimmer 854. Moreover, the 555 timer 902 may alternatively be implemented as an astable multivibrator. The 555 timer 904 may be implemented as a monostable multivibrator with suitable modifications in certain embodiments. Various combinations of these implementations may also be used without departing from the scope of the invention.

Figure 16:
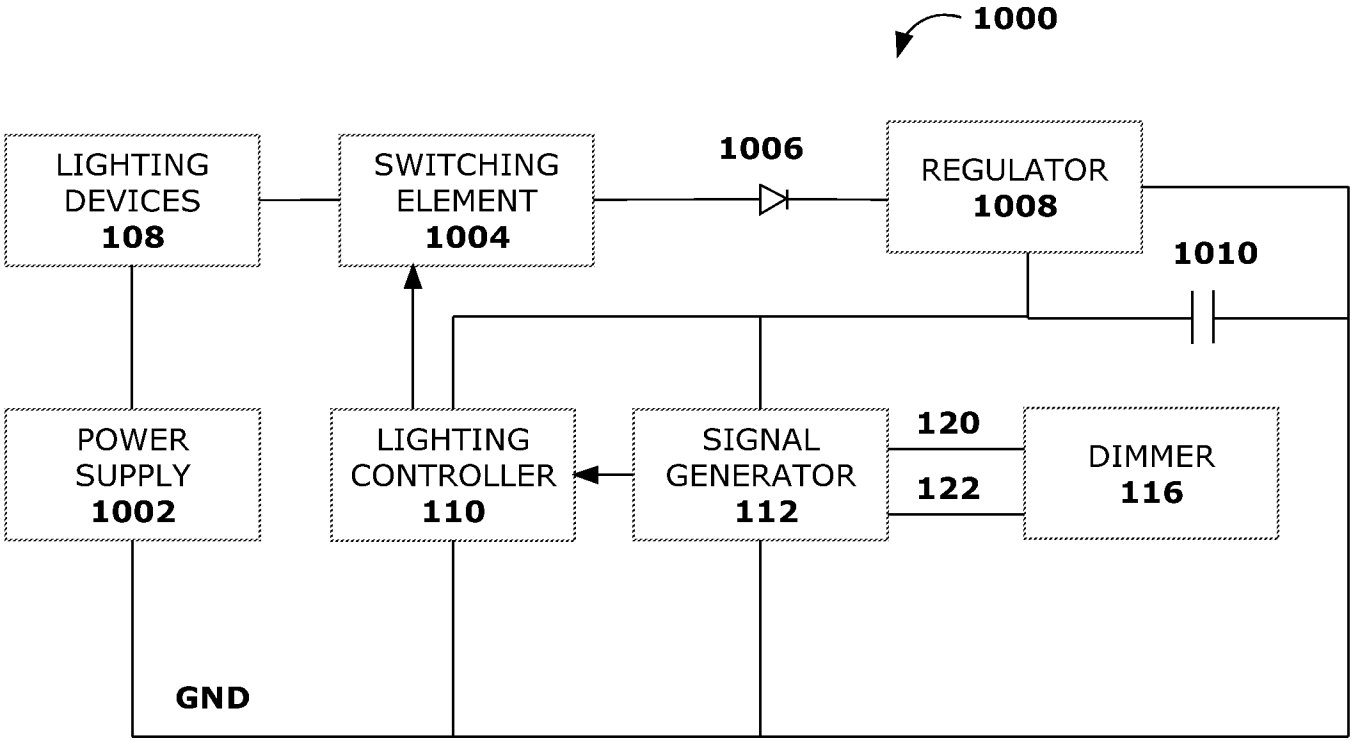
FIG. 16 is a system architecture diagram of an embodiment of the invention having a second embodiment of a power supply architecture.

Lighting apparatus 1000 may have an alternative power supply architecture to provide a source of power to the lighting controller 110 and signal generator 112 as illustrated in FIG. 16. The lighting controller 110, signal generator 112, and dimmer 116 may be coupled together and operate as previously described but be provided with a source of power in a different manner. Power supply 1002 may be a DC power supply and may be coupled between the lighting devices 108 and a reference ground GND. The lighting devices 108 may be a plurality of LEDs that may be coupled together in various combinations. The lighting devices 108 may be coupled to a switching element 1004 that may be controlled by the lighting controller 110. The switching element 1004 may be implemented as a transistor or a plurality of transistor and may operate under the control of the lighting controller 110 to provide a PWM signal through the lighting devices 108. The switching element 1004 may also be coupled in series to a diode 1006 and regulator 1008 that may be coupled between the switching element 1004 and a reference ground GND. The regulator 1008 may also have an output that may be coupled to the lighting controller 110 and signal generator 112 to provide a source of DC power to the lighting controller 110 and signal generator 112. A capacitor 1010 may also be coupled between the output of the regulator 1008 and ground. In one particular implementation, the switching element 1004 may be a MOSFET transistor, such as the FDN337N transistor manufactured by Fairchild Semiconductor. Similarly, the regulator 1008 may be a 5 volt regulator; the diode 1006 may be a 1N4148 diode manufactured by NXP semiconductor; and the capacitor 1010 may be a 1 mF capacitor. Other component values may be used in other implementations without departing from the scope of the invention.

In other embodiments of the invention, different configurations may also be used to provide a source of DC power to the lighting controller 110 and signal generation circuit 112 without departing from the scope of the invention.

Figure 17:
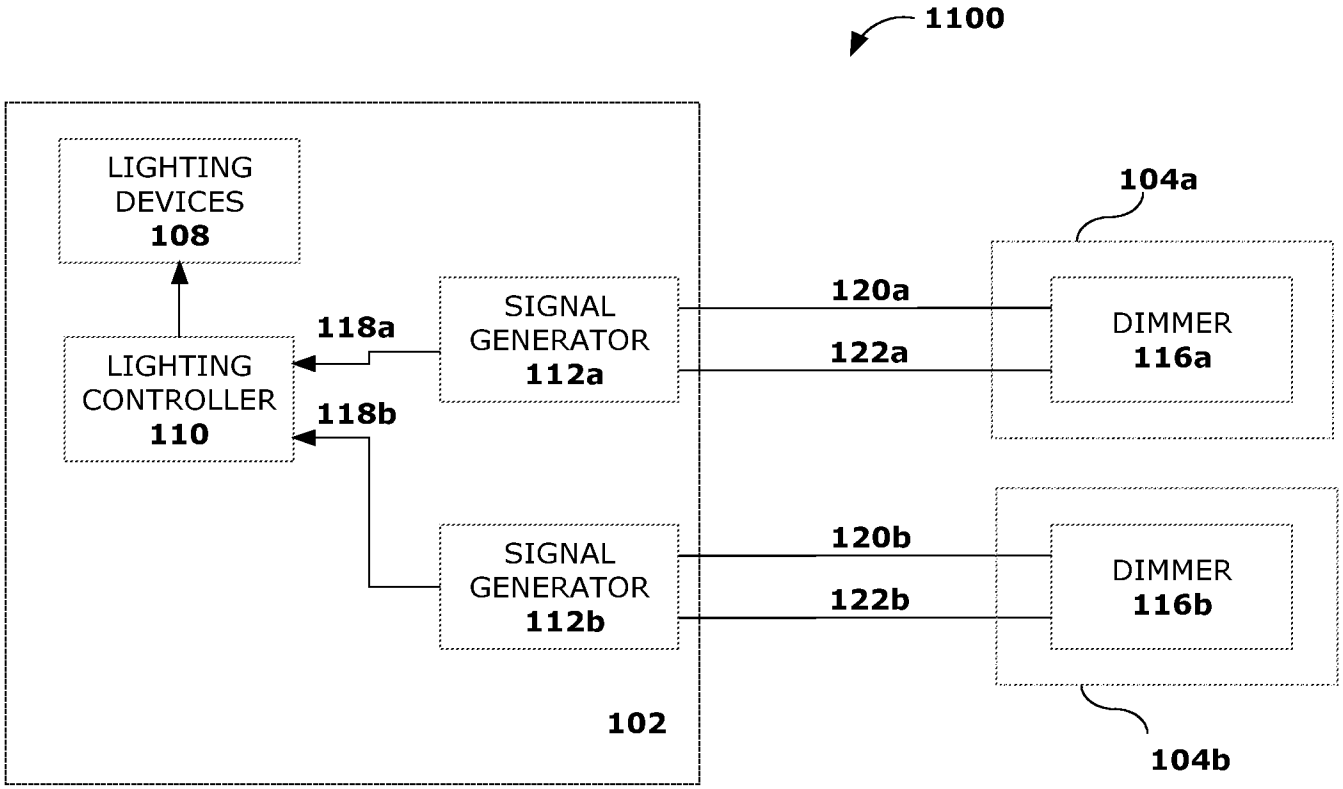
FIG. 17 is a system architecture diagram of an embodiment of the invention having multiple dimmers.

Certain other embodiments of the invention may include more than one control apparatus 104 to control different aspects of the light output from the lighting devices 108 (light radiating element) as noted above. For example, lighting apparatus 1100 as shown in FIG. 17 incorporates a control apparatus 104*a* comprising a dimmer 116*a* and a control apparatus 104*b* comprising a dimmer 116*b*. Each of control apparatus 104*a* and 104*b* may be connected to a signal generator 112*a* and 112*b* via lines 120*a*, 122*a* and 120*b*, 122*b* respectively. The signal generators 112*a* and 112*b* may be operable to generate output signals 118*a* and 118*b* respectively and to provide these output signals to a lighting controller 110. The dimmers 116*a* and 116*b* and signal generators 112*a* and 112*b* may operate as described previously with like numbers having similar functionality so that the output signals 118*a* and 118*b* may have periods that are representative of the values of the interfaces of the dimmers 116*a* and 116*b* respectively. The power supplied architecture has been omitted from FIG. 17 for simplicity but may be implemented in a similar manner to that shown in FIG. 1B.

The lighting controller 110 may control one aspect of the light output from the lighting devices 108 (light radiating element), for example the intensity, based on the period of the output signal 118*a*. The lighting controller 110 may control another aspect of the light output from the lighting devices 108 (light radiating element), for example the color temperature, based on the period of the output signal 118*b*. More specifically, in one embodiment where the lighting devices 108 are LEDs, the lighting controller may set the relative intensity of at least one LED set having LEDs of a first wavelength to a first value and/or set the relative intensity of at least one other LED set having LEDs of a second wavelength to a second value to set the color temperature of the light output from the lighting devices 108 (light radiating element). Likewise, to set the intensity of the light output from the lighting devices 108 (light radiating element), the lighting controller 110 may set the intensity of light emitted from all LED sets. In certain embodiments, the lighting controller 110 may change the duty cycle of a PWM signal supplied to each LED sets to increase or decrease the intensity of the light emitted from the particular LED set to alter the light output from the lighting apparatus 1100.

Alternatively, a control apparatus 104 may have multiple dimmers that may or may not be connected to separate signal generation circuits depending on the particular implementation. Additionally, more than two control apparatus or a control apparatus having more than two dimmers may be employed in certain embodiments of the invention used with a lighting controller 110 that is operable to control more than two aspects of the light output from the lighting devices.

The present invention described above is focused on the control of a lighting apparatus. It should be understood that the use of a TRIAC dimmer as described could be used to control other devices and is not limited to lighting apparatus. For instance, the output signal 118 of FIG. 3 could be used to control an aspect of a apparatus (machine, device, network, etc.) that performs non-lighting functionality. In particular examples, the output signal of FIG. 3 could be used to control: the operational speed of an apparatus (ex. a fan, sewing machine, assembly line conveyer belt, assembly line machine, timer, air conditioner etc.); the audio volume on of an apparatus (ex. television, stereo, radio, public announcement system, etc.); the temperature within a location (ex. a building, room or apparatus (ex. fridge)); the frequency of an apparatus (ex. strobe light, fan, audio apparatus) and/or the position of an apparatus (ex. factory assembly line machine, construction apparatus, window coverings, position/angle of an antenna etc.).

Although the above description described the signal generator 112 as a separate element from the lighting controller 110, it should be understood that the signal generator 112 or a portion thereof could be integrated within the lighting controller 110. For example, the component 302 within the signal generator 112 could be integrated within the lighting controller 110. In one particular case, an ASIC chip could be used to integrate different aspects of the system together. In another case, software within a microcontroller or other component could be used to implement the functionality of the signal generator or a portion thereof within the lighting controller 110.

Although various embodiments of the present invention have been described and illustrated, it will be apparent to those skilled in the art that numerous modifications and variations can be made without departing from the scope of the invention, which is defined in the appended claims.

What is claimed is:

1. A control apparatus adapted for use with a dimmer, the dimmer comprising a variable impedance and an interface operable to change the variable impedance, the variable impedance in series with a capacitor coupled between a connection node and a reference ground, the control apparatus comprising:

a signal generation circuit coupled to the dimmer at the connection node and operable to generate an output signal whose period is dictated at least in part by the impedance of the variable impedance;

a lighting controller operable:

to receive the output signal from the signal generation circuit;

detect a first period of the output signal when the interface of the dimmer is adjusted to a first extreme value by a user;

detect a second period of the output signal when the interface of the dimmer is adjusted to a second extreme value by a user; and control an aspect of light output from a lighting apparatus based at least partially on the period of the output signal relative to the first and second periods.

2. The control apparatus according to claim 1, wherein the lighting controller is operable to control the aspect of light output so that the perceived change to the aspect of light output appears to vary approximately linearly with the period of the output signal relative to the first and second periods.

3. The control apparatus according to claim 1, wherein the lighting controller is operable to control the aspect of light output based on the percentage value that the output signal is between the first and second periods.

4. The control apparatus according to claim 1, wherein the dimmer is a TRIAC dimmer.

5. The control apparatus according to claim 1, the TRIAC dimmer further comprising integrated TRIAC circuitry in parallel with the variable impedance that is activated at a trigger voltage, wherein the voltage at the connection node is maintained below a trigger voltage for the TRIAC circuitry such that the TRIAC circuitry never activates.

6. The control apparatus according to claim 1, wherein the aspect of the light output comprises one of an intensity level, a color or a color temperature of the light output.

7. A control apparatus adapted for use with a dimmer comprising an interface, the interface being adjustable to a plurality of states, the control apparatus comprising:

a lighting controller adapted to receive an output signal having a period representative of the state of the interface of the dimmer and operable to:

determine a maximum value for the period of the output signal;

determine a minimum value for the period of the output signal; and control an aspect of light output from a lighting apparatus based at least partially on a present value for the period of the output signal relative to the maximum and minimum values.

8. The control apparatus of claim 7, wherein the lighting controller is operable to determine the maximum and minimum values in close proximity to the present value for the period of the output signal when the lighting controller is in a programming mode.

9. The control apparatus of claim 7, wherein the lighting controller is operable to determine the maximum and minimum values in a programming mode.

10. The control apparatus of claim 9, wherein the lighting controller is operable to enter a programming mode upon initialization.

11. The control apparatus of claim 7, wherein the lighting controller is operable to detect if the present value for the period of the output signal is greater than the maximum value and, if so, to set the maximum value to the present value for the period of the output signal.

12. The control apparatus of claim 7, wherein the lighting controller is operable to detect if the present value for the period of the output signal is less than the minimum value and, if so, to set the minimum value to the present value for the period of the output signal.

13. The control apparatus according to claim 7, wherein the lighting controller is operable to control the aspect of light output so that the perceived change to the aspect of light output appears to vary approximately linearly with the present value for the period of the output signal relative to the maximum and minimum values.

14. The control apparatus according to claim 7, wherein the lighting controller is operable to control the aspect of light output based on the percentage value that the present value for the period of the output signal is between the maximum and minimum values.

15. The control apparatus according to claim 7, further comprising a signal generation circuit operable to be coupled to the dimmer, the signal generation circuit operable to generate the output signal that is received by the lighting controller.

16. The control apparatus of claim 15, wherein the dimmer comprises a variable impedance that is dependent on a present state of the interface, the variable impedance in series with a capacitor coupled between a connection node and a reference ground, and wherein the signal generation circuit is coupled to the dimmer at the connection node.

17. The control apparatus of claim 16, wherein the period of the output signal generated by the signal generation circuit is dictated at least in part by the impedance of the variable impedance.

18. The control apparatus of claim 15, wherein the dimmer is a TRIAC dimmer.

19. The control apparatus according to claim 18, the TRIAC dimmer further comprising integrated TRIAC circuitry in parallel with the variable impedance that is activated at a trigger voltage, wherein the voltage at the connection node is maintained below a trigger voltage for the TRIAC circuitry such that the TRIAC circuitry never activates.

20. A lighting apparatus incorporating the control apparatus of claim 7, further comprising:

at least one LED; and wherein the lighting controller is operable to cause a pulse width modulation signal to be supplied to the at least one LED, wherein a duty cycle of the pulse width modulation signal is based at least partially on the present value for the period of the output signal relative to the maximum and minimum values.

21. A control apparatus for use with a dimmer, the dimmer comprising a variable impedance and an interface operable to change the variable impedance, the variable impedance in series with a capacitor coupled between a connection node and a reference ground, the control apparatus comprising:

a signal generation circuit coupled to an impedance matching circuit and operable to generate an output signal whose period is dictated at least in part by the impedance of the variable impedance of the dimmer;

the impedance matching circuit coupled between the connection node of the dimmer and the signal generation circuit, wherein the impedance matching circuit is calibrated to define a predetermined maximum period and a predetermined minimum period of the output signal; and a lighting controller operable to receive the output signal and control an aspect of light output from a lighting apparatus based at least partially on the period of the output signal relative to the predetermined maximum and minimum periods.

22. The apparatus of claim 21, the impedance matching circuit comprising a first variable impedance coupled between the connection node of the dimmer and the signal generation circuit.

23. The apparatus of claim 22, the impedance matching circuit further comprising a second variable impedance coupled between the connection node of the dimmer and the reference ground.

24. A lighting apparatus for use with a dimmer comprising an interface, the interface being adjustable to a plurality of states, the lighting apparatus comprising:

a light radiating element;

a lighting controller adapted to receive an output signal having a period representative of the state of the interface of the dimmer and operable to:

determine a maximum value for the period of the output signal;

determine a minimum value for the period of the output signal; and control an aspect of light output for the light radiating element based at least partially on the present value for the period of the output signal relative to the maximum and minimum values.

25. The lighting apparatus according to claim 24 further comprising a signal generation circuit operable to be coupled to the dimmer, the signal generation circuit operable to generate the output signal that is received by the lighting controller.

26. The lighting apparatus of claim 24, the light radiating element comprising at least one LED.

* * * * *